US012584300B2

(12) United States Patent
L'Henaff et al.

(10) Patent No.: US 12,584,300 B2
(45) Date of Patent: Mar. 24, 2026

(54) KITCHEN SINK SYSTEM WITH INTERCHANGEABLE SINK COMPONENTS

(71) Applicant: AS America, Inc., Piscataway, NJ (US)

(72) Inventors: Jean-Jacques L'Henaff, New Canaan, CT (US); Ki Bok Song, Plainview, NY (US); Jacob Nitz, London (GB); Alison J. Lyons, Jersey City, NJ (US); Paul Flowers, London (GB); Greg Reinecker, Brooklyn, NY (US)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 18/687,593

(22) PCT Filed: Sep. 2, 2022

(86) PCT No.: PCT/US2022/075932
§ 371 (c)(1),
(2) Date: Feb. 28, 2024

(87) PCT Pub. No.: WO2023/034981
PCT Pub. Date: Mar. 9, 2023

(65) Prior Publication Data

US 2024/0401314 A1 Dec. 5, 2024

Related U.S. Application Data

(60) Provisional application No. 63/240,757, filed on Sep. 3, 2021.

(51) Int. Cl.
*E03C 1/186* (2019.01)
*E03C 1/182* (2006.01)

(52) U.S. Cl.
CPC ..... *E03C 1/186* (2013.01); *E03C 1/182* (2013.01)

(58) Field of Classification Search
CPC ..... E03C 1/186
See application file for complete search history.

(56) References Cited

U.S. PATENT DOCUMENTS 4,456,021 A 6/1984 Leavens
D352,771 S 11/1994 Walsh
(Continued)

FOREIGN PATENT DOCUMENTS

CN 213883107 U 8/2021
DE 202009004461 U1 9/2009
(Continued)

OTHER PUBLICATIONS

Amazon.com order of Jun. 14, 2021 for "Kohler 80084-1 PC-NA Task Kitchen Sink 33", shipped on Jun. 19, 2021. Copy of order was made on Apr. 20, 2023 (2 pages).
(Continued)

*Primary Examiner* — Lauren A Crane
(74) *Attorney, Agent, or Firm* — Morrison & Foerster LLP

(57) ABSTRACT

Provided kitchen sink systems having interchangeable sink components. A kitchen sink system according to embodiments can include a sink basin comprising an upper rear surface and an upper front surface and a plurality of interchangeable sink components configured to removably couple to the sink basin. Each of interchangeable sink components has a first edge and a second edge, such that the first edge is configured to mate with the upper rear surface of the sink basin and the second edge is configured to mate with the upper front surface of the sink basin. Further, a first interchangeable sink component is configured to removably couple to the sink basin at a first height a second interchangeable sink component is configured to removably
(Continued)

couple to the sink basin at a second height, wherein the first height is greater than the second height.

19 Claims, 24 Drawing Sheets

(56) References Cited

U.S. PATENT DOCUMENTS

| | | | | |
|---|---|---|---|---|
| 8,070,110 | B2 | 12/2011 | Jones et al. | |
| 9,574,333 | B2 | 2/2017 | O'Brien et al. | |
| 9,783,967 | B2 | 10/2017 | Jain et al. | |
| 11,129,501 | B2 | 9/2021 | Detlaff | |
| 2008/0148475 | A1 | 6/2008 | Lin | |
| 2010/0275369 | A1 | 11/2010 | Eilmus et al. | |
| 2011/0088784 | A1* | 4/2011 | Meehan | F16K 27/0263 137/1 |
| 2012/0204343 | A1* | 8/2012 | Shollmier | A47B 77/08 4/631 |
| 2012/0266377 | A1 | 10/2012 | Eilmus | |
| 2013/0283521 | A1 | 10/2013 | Jain et al. | |

FOREIGN PATENT DOCUMENTS

| | | | |
|---|---|---|---|
| DE | 202015104815 | U1 | 10/2015 |
| DE | 102015122606 | A1 | 6/2017 |
| EP | 1275786 | A2 | 1/2003 |
| EP | 3382112 | A1 | 10/2018 |
| JP | 6680566 | B2 | 4/2020 |
| KR | 20-0337576 | Y1 | 1/2004 |
| KR | 20-2010-0006148 | U | 6/2010 |

OTHER PUBLICATIONS

Amazon.com order of May 9, 2019 for "Elkay Quartz Luxe ELXHU3322RJBO Jubilee Offset 60/40 Double Bowl Undermount Sink with Aqua Divide" and excerpt of Amazon-Homepage for said order. Copy of order was made on Jul. 10, 2023. (2 pages).

Kraus USA. (2021). "Workstation Accessories", located at https://www.kraususa.com/kitchen/kitchen-accessories/workstation-accessories.html. (5 pages).

Pictures taken from the originally shipped and received package of "Kohler 80084-1 PC-NA Task Kitchen Sink 33", (4 pages).

Ruvati. (2021). "33-inch Workstation Two-Tiered Ledge KitchenSink Undermount 16 Gauge Stainless Steel—RVH8222"' located at https://www.ruvati.com/products/rvh8222-33-inch-workstation-two-tiered-ledge-kitchen-sink-undermount-16-gauge/. (10 pages).

Summary of excerpts of Amazon-Homepage for "Kohler 80084-1 PC-NA Task Kitchen Sink 33" (2023). (1 page).

Kohler: "Amazon.com: Kohler Task 33" Top-/Undermount Single-Bowl Workstation Kitchen Sink, Includes Accessories, StainlessSteel, 2 Faucet Holes, K-80084-2PC-NA", Feb. 26, 2021 (Feb. 26, 2021), Retrieved from the Internet: URL:https://www.amazon.com/KOHLER-Kitchen-Stainless-Workstation-K-80084-2PC-NA/dp/B08XKLZNHJ?th=1 (12 pages).

Kohler: "Kohler 5540-NA Prolific 33 Inch Workstation Stainless Steel Single Bowl Kitchen Sink with Included Accessories, Undermount Installation, Stainless Steel—Amazon.com", Jan. 14, 2015 (Jan. 14, 2015), Retrieved from the Internet: URL:https://www.amazon.com/Workstation-Accessories-Undermount-installation-K-5540-NA/dp/B00S8ERF3A/ref=sr_1_1?crid=2GG05K3RO5BQP&dib=eyJ2IjoiMSJ9.IdFVYYD27OxkinhruFpGdLzR_dt-Y8s-IZvFj_Y4QUjJUYBMDGdlin2_IW9bpLb-KI9JK5YS7YeOQE01agyASZj-BddTA_G4L4KoBQ786DxoVgtAdEA4yrXAgl0m2huhOAjOHDAin1LaAznwre2Y1JoWhtSXhl (10 pages).

Kohler: "Prolific(TM) Stainless Steel Kitchen Sink—Kohler", Feb. 25, 2016 (Feb. 25, 2016), Retrieved from the Internet: URL:https://www.youtube.com/watch?v=Ku_07hnSDpg (2 pages).

* cited by examiner

KITCHEN SINK SYSTEM WITH INTERCHANGEABLE SINK COMPONENTS

CROSS-REFERENCE TO RELATED APPLICATIONS

This application is a U.S. national stage application under 35 U.S.C. § 371 of International Application No. PCT/US2022/075932, filed internationally on Sep. 2, 2022, which claims the benefit of U.S. Provisional Application No. 63/240,757, filed Sep. 3, 2021. The entire contents of each priority application is incorporated herein by reference.

FIELD

The present disclosure generally relates to kitchen sink systems, and in particular, to kitchen sink systems having a plurality of interchangeable sink components such as a tray, colander, and/or cutting board that are configured to be positioned over the sink basin as needed.

BACKGROUND

Conventional kitchen sink systems include, at a most basic level, a faucet, a sink basin to receive water from the faucet, and a drain for water to exit the sink basin. A conventional kitchen sink is generally used for washing dishes and food preparation. However, many conventional kitchen sinks monopolize a large amount of countertop space that cannot otherwise be used for food or drink preparation.

SUMMARY

Provided herein are kitchen sinks that include several interchangeable sink components in addition to the standard water faucet such as a cutting board, a colander, and/or a tray. One or more of the interchangeable sink components, (e.g., the cutting board, colander, and/or tray) may be interchangeable in that they can removably couple to a top edge of the sink basin to more effectively utilize the kitchen sink. In particular, the kitchen sinks described herein may more effectively use space, minimize the amount of cleaning after food/beverage preparation, and allow a user to more effectively prepare food and/or beverages relative to conventional kitchen sinks. For example, because the kitchen sinks described herein include various interchangeable sink components (e.g., cutting board, tray, colander), the amount of countertop space necessary for food/beverage preparation is minimized. Instead of needing countertop space to place a cutting board, the cutting board of the present disclosure may be placed directly over the open sink basin. This may be especially beneficial in smaller kitchens with limited countertop space. Additionally, the kitchen sinks described herein can also minimize the amount of cleaning necessary after the sink is used for food/beverage preparation. Specifically, because the interchangeable sink components are designed to be placed just over the sink basin (e.g., coupled to the top edge of the sink basin), any water or food waste can fall directly into the sink basin for easy clean up. Further, because the described kitchen sinks include the interchangeable sink components that are not included in a conventional kitchen sink system, one using the disclosed kitchen sink system can more effectively prepare food and beverages. The sink system's interchangeable sink components allow the user to perform more tasks at one location within the kitchen (i.e., at the sink) instead of having to move back and forth between a preparation station (e.g., countertop space, cutting board) and the sink.

In some embodiments, a kitchen sink system may also include a retractable nozzle feature. The retractable nozzle feature may be particularly useful for a sink that is used for beverage preparation. A retractable nozzle feature may include a retractable nozzle, a tray, and an actuating mechanism for actuating the nozzle. The nozzle may be configured to eject pressurized air or water to dry or rinse an item such as a glass (e.g., drinking glass, pint glass, cup, shot glass, mug) or a bowl. The retractable nozzle feature may be a permanent fixture in the kitchen sink system. In some embodiments, the retractable nozzle feature may be an interchangeable sink component. In some embodiments, the retractable nozzle feature may include one or more nozzles that are configured to extend vertically when being used to dry an object (e.g., a glass) and retract when not in use.

In some embodiments, the one or more interchangeable sink components are configured to be removably coupled to a top of a sink basin. For example, a cutting board (i.e., an interchangeable sink component) may be configured to removably attach to the top edge of a sink basin such that two opposing edges of the cutting board are in contact with two opposing top edges of a sink basin. In some embodiments, the interchangeable sink component (e.g., cutting board) may be configured to removably couple to the top edge of the sink basin by simply resting on top of the top edge of the sink basin. Other interchangeable sink components of the kitchen sink, such as a tray, and/or a colander may similarly be configured to removably couple to the sink basin.

In some embodiments, the one or more interchangeable sink components that are configured to be removably coupled to the sink basin are also configured to slide back and forth along the top edge of the sink basin. For example, a user may have a cutting board removably coupled to the sink system to use for chopping vegetables. When done chopping, the user may slide the cutting board to one side to make room for a colander (another interchangeable sink component also removably coupled to the sink basin). The user could then, for example, push the chopped vegetables off the edge of the cutting board and into the colander for rinsing.

In some embodiments, one or more of the interchangeable sink components are configured to rest at different heights when removably coupled to the top edge of the sink basin. This can allow one interchangeable sink component, for example a cutting board, to slide past and over top of another interchangeable sink component, such as a colander or drying tray. This feature can allow the user to reorient and reconfigure the interchangeable sink components without having to remove (i.e., uncouple) one or more of the interchangeable sink components from the sink system. For instance, in the chopping vegetables example provided above, the cutting board may be configured to slide over top of the colander. Thus, the user can slide the cutting board back and forth as needed without having to remove and replace the colander to make room for the cutting board as it moves from one location to another.

In some embodiments, provided is a kitchen sink system, the kitchen sink system comprising: a sink basin comprising an upper rear surface and an upper front surface; and a plurality of interchangeable sink components configured to removably couple to the sink basin, each interchangeable sink component of the plurality of interchangeable sink components comprising a first edge and a second edge opposite the first edge, wherein the first edge of each interchangeable sink component is configured to align with the upper rear surface of the sink basin and the second edge of each interchangeable sink component is configured to align with the upper front surface of the sink basin, wherein a first interchangeable sink component is configured to removably couple to the sink basin at a first height as measured vertically from a bottom surface of the sink basin to a horizontal plane that intersects with a top of the first edge and the second edge of the first interchangeable sink component, and a second interchangeable sink component is configured to removably couple to the sink basin at a second height as measured vertically from a bottom surface of the sink basin to a horizontal plane that intersects with a top of the first edge and second edge of the second interchangeable sink component, wherein the first height is greater than the second height, and the first interchangeable sink component is configured to slide past the second interchangeable sink component along the upper rear surface and upper front surface of the sink basin.

In some embodiments of the kitchen sink system, the sink basin comprises a double sink basin comprising a first basin separated from a second basin by a sink divider, wherein an upper surface of the sink divider is lower than a lowest surface of the first interchangeable sink component such that the first interchangeable sink component is configured to slide from the first basin to the second basin while removably coupled to the upper rear surface and the upper front surface of the sink basin.

In some embodiments of the kitchen sink system, both the upper rear surface and the upper front surface of the sink basin are chamfered at an angle between about 30 and about 60 degrees.

In some embodiments of the kitchen sink system, both the first edge of a second interchangeable sink component and the second edge of the second interchangeable sink component are chamfered.

In some embodiments of the kitchen sink system, the first edge of a second interchangeable sink component is a first chamfered edge and the upper front surface of the sink basin is a upper front chamfered surface, and a height of the first chamfered edge of the second interchangeable sink component as measured from a top of the first chamfered edge, along a surface of the first chamfered edge, and to a bottom of the first chamfered edge is shorter than a height of the upper front chamfered surface of the sink basin as measured from a top of the upper front chamfered surface, along a surface of the upper front chamfered surface, and to a bottom of the upper front chamfered surface.

In some embodiments of the kitchen sink system, the first edge and the second edge of the first interchangeable sink component each comprise a chamfered portion.

In some embodiments of the kitchen sink system, wherein the kitchen sink system comprises a retractable nozzle feature, the retractable nozzle comprising: a base surface proximate to the sink basin, wherein a side edge of the base surface extends from a top portion of a side surface of the sink basin; one or more retractable nozzles disposed in the base surface; and an actuating mechanism, wherein when the actuating mechanism is actuated, the one or more retractable nozzles are configured to extend upward from the base surface, and when the actuating mechanism is not actuated, the one or more retractable nozzles are configured to retract such that a top surface of the one or more retractable nozzles is flush with a portion of the base surface.

In some embodiments of the kitchen sink system, the one or more retractable nozzles are configured to dispense pressurized air.

In some embodiments of the kitchen sink system, the one or more retractable nozzles are configured to dispense water.

In some embodiments of the kitchen sink system, the plurality of interchangeable sink components can comprise one or more of a cutting board, a drying tray, or a colander.

In some embodiments of the kitchen sink system, the first interchangeable sink component comprises a cutting board.

In some embodiments of the kitchen sink system, the second interchangeable sink component comprises a drying tray, wherein the drying tray comprises a plurality of openings allowing water to pass from an interior surface of the drying tray, through the plurality of openings, and into the sink basin.

In some embodiments of the kitchen sink system, a third interchangeable sink component comprises a colander, wherein the colander comprises a plurality of openings allowing water to pass from an interior surface of the colander, through the plurality of openings, and into the sink basin.

In some embodiments of the kitchen sink system, a fourth interchangeable sink component configured to removably couple to the sink basin at a fourth height as measured vertically from a bottom surface of the sink basin to a horizontal plane that intersects with a top of the first edge and the second edge of the fourth interchangeable sink component, wherein the first height and the fourth height are the same.

In some embodiments of the kitchen sink system, a distance between a rear side interior surface of the sink basin and a front side interior surface of the sink basin is shorter than a width of each interchangeable sink component, the width of each interchangeable sink component being measured along a top of the interchangeable sink component between the first edge and the second edge, such that each interchangeable sink component is configured to removably couple to the sink basin by placing each interchangeable sink component over the sink basin and aligning the first edge of each interchangeable sink component with the upper rear surface of the sink basin and the second edge of each interchangeable sink component with the upper front surface of the sink basin.

In some embodiments of the kitchen sink system, a width of the first interchangeable sink component is greater than a width of the second interchangeable sink component, wherein the width of the first interchangeable sink component is measured along a top of the first interchangeable sink component from the first edge to the second edge, and the width of the second interchangeable sink component is measured along a top of the second interchangeable sink component from the first edge to the second edge.

In some embodiments, any one or more of the features, characteristics, or elements discussed above with respect to any of the embodiments may be incorporated into any of the other embodiments mentioned above or described elsewhere herein.

DETAILED DESCRIPTION

Figure 1A:
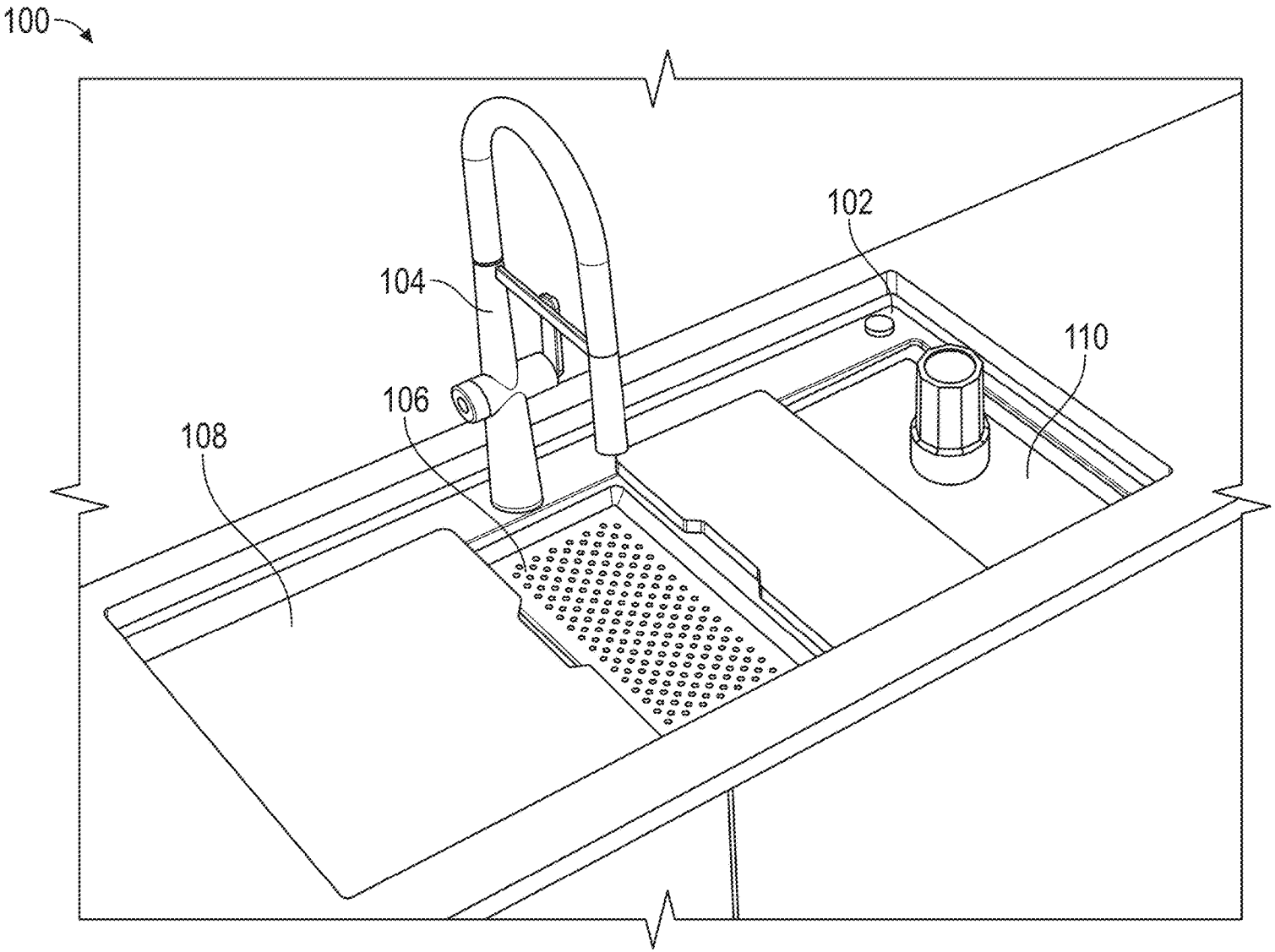
FIG. 1A shows a perspective view of a kitchen sink system, according to some embodiments.

Described herein are kitchen sink systems. Specifically, the kitchen sink systems described herein include one or more interchangeable sink component that is configured to be removably coupled a top edge of a sink basin of the kitchen sink system. In some embodiments, a kitchen sink system can include two or more interchangeable sink components that are configured to stack and/or slide past one another along the top edge of the sink basin of the kitchen sink system.

The kitchen sink systems described herein include a plurality of interchangeable sink components that can be removably coupled to the kitchen sink system (e.g., at the top edge of the sink basin) at various heights. For example, the front and rear top edges of the sink basin may be chamfered. Each of the interchangeable sink components may also include two opposing edges that are complementarily chamfered. When removably coupled to the top edges of the sink basin, the chamfered edges of an interchangeable sink component align with the chamfered edges of the sink basin. In some embodiments, the size and shape of each interchangeable sink component is slightly different such that each interchangeable sink component can removably couple to the sink basin at a different height. Specifically, the width (as measured from a first chamfered edge to a second chamfered edge opposite the first chamfered edge) may be different between two or more interchangeable sink components. This difference in width allows each interchangeable sink component to rest at different heights. When resting at different heights, one or more interchangeable sink component may be configured to slide over and past another interchangeable sink component.

Additionally, in some embodiments, a height of the chamfered edge of each interchangeable sink components is less than a height of the chamfered edge of the sink basin, wherein the height of each interchangeable sink component is measured from a top of the chamfered surface, along the angled surface of the chamfered surface (which is facing the chamfered top edge of the sink basin when removably coupled to the sink basin), and to the bottom of the chamfered surface, and the height of the chamfered edge of the sink basin is measured from a top of the chamfered edge, along the angled surface of the chamfered edge (which is facing the chamfered surface of the interchangeable sink component when the interchangeable sink component is removably coupled to the sink basin), and to the bottom of the chamfered edge.

In some embodiments, the kitchen sink system may also include a retractable nozzle feature configured to rinse glasses, dishes, and the like. The retractable nozzle feature may include a base surface comprising a nozzle. The base surface may include a plurality of openings to allow water to drip from an upper surface of the base down to the sink basin. The nozzle may be configured to extend vertically from the base when activated. The nozzle may be configured to retract when the retractable nozzle feature is inactivated. In some embodiments, the nozzle may be configured to retract into a space below the surface of the base when inactivated. When activated by an actuating mechanism, the nozzle may eject a spray (e.g., water, soapy water, pressurized air) to clean or dry a dish or glass.

Referring now to the drawings, like parts are marked throughout the specification and drawings with the similar reference numerals, respectively.

Figure 1B:
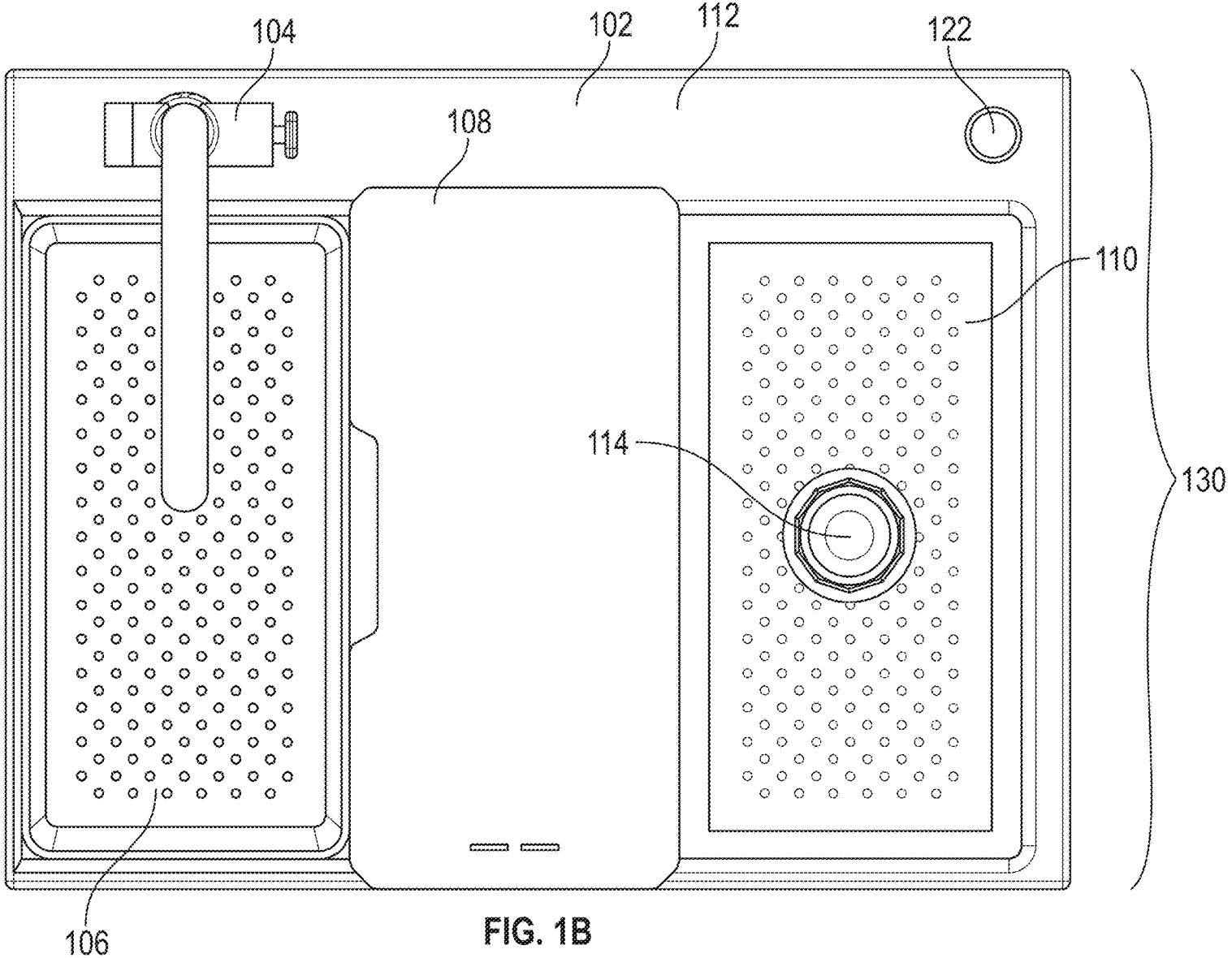
FIG. 1B shows a top view of a kitchen sink system, according to some embodiments.

FIG. 1A shows a perspective view of a kitchen sink system 100 according to some embodiments, and FIG. 1B shows a top view of a kitchen sink system 100 according to some embodiments. Kitchen sink system 100 can include sink basin 102, faucet 104, retractable nozzle feature 130, and a plurality of interchangeable sink components (e.g., 106, 108). In some embodiments sink basin 102 may include a ledge surface 112.

In some embodiments, sink basin 102 may include a single basin. In some embodiments, sink basin 102 may include a double or a triple basin. In some embodiments, sink basin 102 may include a ledge surface 112. Ledge surface 112 may be configured to receive faucet 104, such that faucet 104 is mounted to kitchen sink system 100 at rear ledge surface 112.

In some embodiments, kitchen sink system 100 may include one or more interchangeable sink components. For example, one or more interchangeable sink components may include one or more cutting boards 108 and/or a tray 106. In some embodiments, the one or more interchangeable sink components may include a colander. The one or more interchangeable sink components are configured to removably couple to sink basin 102 of kitchen sink system 100. Specifically, the one or more interchangeable sink components may be configured to removably couple to sink basin 102 by resting on an upper surface of sink basin 102. In some embodiments, the top edge of sink basin 102 may include a surface that is complementary to a surface of an interchangeable sink component. For example, both the top edge of sink basin 102 and an edge surface of one or more interchangeable sink components may be chamfered.

In some embodiments, two or more interchangeable sink components are configured to removably couple to a top/upper surface of the sink basin 102 at different heights. For example, a colander may be configured to removably couple to the top/upper surface of a sink basin 102 at a lower height than a cutting board. This can allow the higher interchangeable sink component (i.e., the cutting board), to be stacked and/or slid over the lower interchangeable sink component (i.e., the colander). With this feature (i.e., being able to removably couple interchangeable sink components on top of each other and/or slid them past each other) provides a more user-friendly kitchen sink system. As shown in FIGS. 1A and 1B, one or more of cutting boards 108 may be configured to removably couple to sink basin 102 at a height that is greater than a height at which tray 106 is configured to removably couple, wherein the height of each removably coupled interchangeable sink component is measured from a bottom surface of sink basin 102 to a horizontal plane which intersects the top of the chamfered edge of the interchangeable sink component.

In some embodiments, kitchen sink system 100 may include a retractable nozzle feature 130. The retractable nozzle feature 130 may be configured to spray water to rinse a dish or drinking glass. In some embodiments, the retractable nozzle feature 130 may include an approximately horizontal base 110 with one or more nozzles 114. The base 110 may include a plurality of holes, and an actuating mechanism 122. The one or more nozzles 114 may be configured to extend up from the base 110 when the retractable nozzle feature 130 is turned on by actuating mechanism 122. In some embodiments, the one or more nozzles 114 may be configured to retract back down when the retractable nozzle feature 130 is turned off by actuating mechanism 122 or by pressing the top of nozzle 114. In some embodiments, actuating mechanism 122 is a button. In some embodiments, when the retractable nozzle feature is actuated, the nozzle 114 is configured to extend upwards and out of the base 110 and eject a spray (e.g., water, soapy water, pressurized air). A dish, for example, a glass, can be placed over the nozzle 114 such that the ejected spray contacts an interior surface of the dish. The spray may then drain from the interior surface of the dish and down through the plurality of holes in the base 110 to the sink basin 102 and to a drain in the sink basin 102. In some embodiments, retractable nozzle feature 130 comprises about 1-20, about 2-10, or about 2-5 nozzles 114. In some embodiments, retractable nozzle feature 130 comprises less than or equal to about 20, about 18, about 16, about 14, about 12, about 10, about 8, about 6, about 4, or about 2 nozzles 114. In some embodiments, retractable nozzle feature 130 comprises more than or equal to about 1, about 2, about 4, about 6, about 8, about 10, about 12, about 14, about 16, or about 18 nozzles 114.

Figure 2A:
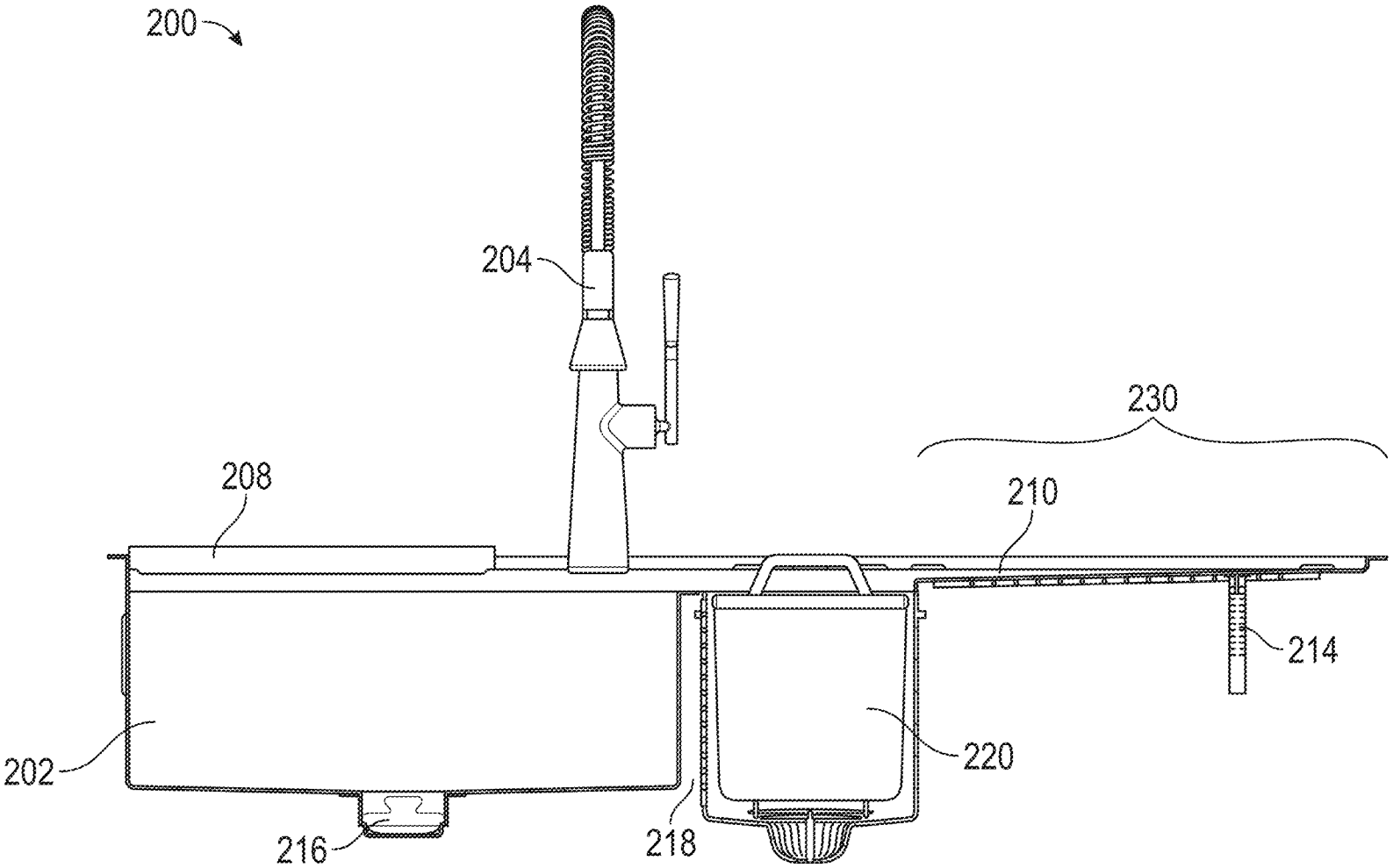
FIG. 2A shows a cross-sectional front view of a kitchen sink system with a retractable nozzle feature, according to some embodiments.
Figure 2C:
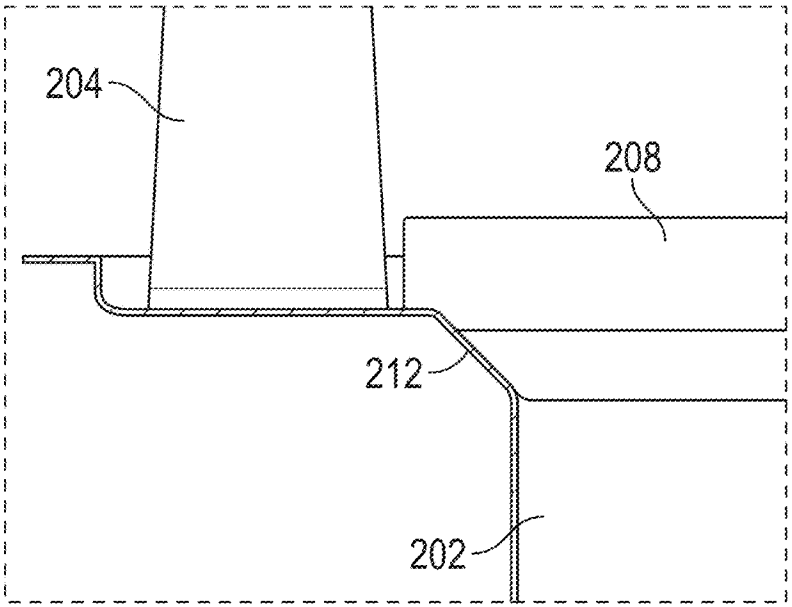
FIG. 2C shows a close-up view of an interchangeable sink component coupled to an upper surface of a kitchen sink, according to some embodiments.
Figure 2B:
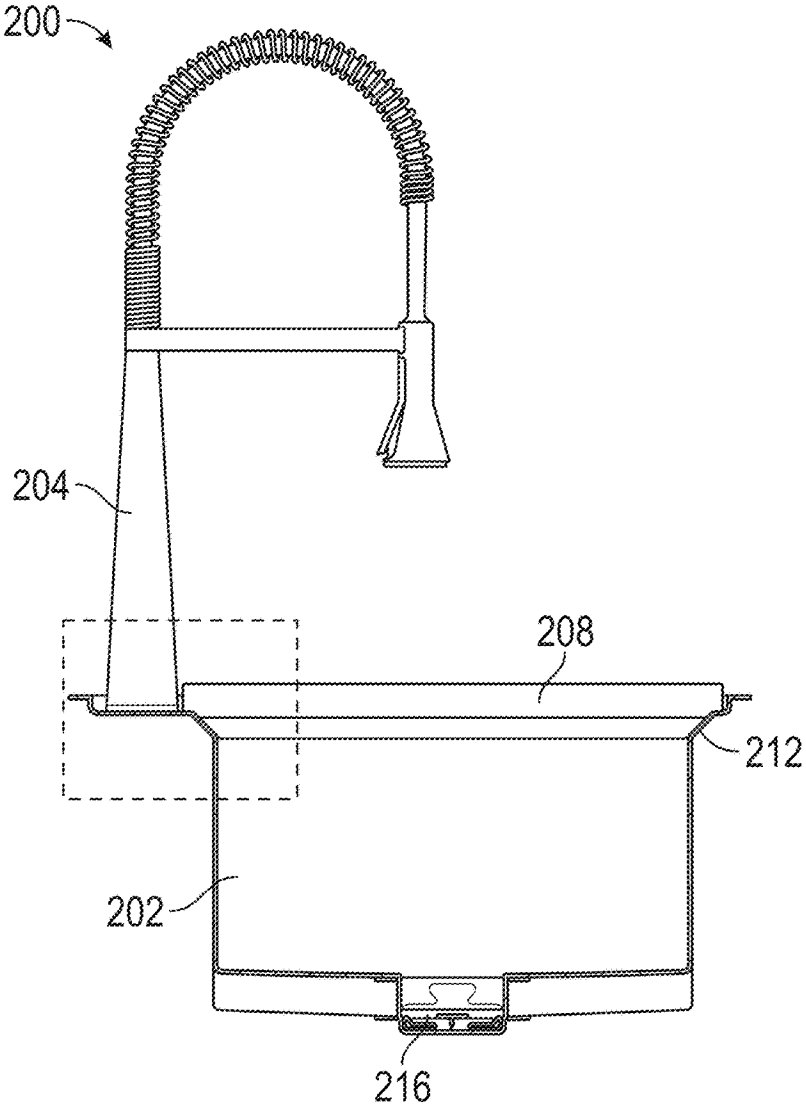
FIG. 2B shows a cross-sectional side view of a kitchen sink system, according to some embodiments.

FIG. 2A shows a front cross-sectional view of kitchen sink system 200, according to some embodiments, and FIG. 2B shows a side cross-sectional view of kitchen sink system 200, according to some embodiments. As shown, kitchen sink system 200 can include sink basin 202, drain 216, sink divider 218, faucet 204, a retractable nozzle feature 230 including a base 210 and nozzle 214, and interchangeable sink components including colander 220 and cutting board 208. The interchangeable sink components may be configured to removably couple to the sink basin 202 at an upper surface 212. In some embodiments, one or more interchangeable sink components may be configured to removably couple to the sink basin 202 without interacting with upper surface 212. For example, a colander may be configured to rest on the sink basin floor without interacting with upper surface 212.

As shown, upper surface 212 of sink basin 202 may be chamfered. In some embodiments, both the rear edge (rear upper surface) and the front edge (front upper surface) of sink basin 202 may be chamfered.

A chamfered upper surface 212 can allow the interchangeable sink components to sit or rest on the chamfered edge 212 at different heights if the interchangeable sink components are slightly different widths (as measured from the top of a first chamfered edge of the interchangeable sink component, across the top of the interchangeable sink component, and to the top of a second chamfered edge of the interchangeable sink component). For example, cutting board 208 may have a slightly larger width than that of colander 220. This can allow cutting board 208 to sit on upper surface 212 (i.e., front and rear upper surfaces) at a slightly greater height than colander 220, allowing cutting board 208 to be positioned over, or even slide along upper surface 212 and over top of, colander 220. In some embodiments colander 220 is designed to fit in a first basin of a double or triple sink basin. For example, colander 220 may not be configured to removably couple to the upper surface 212 of sink basin 202, but may instead include a bottom surface and four side surfaces that are complementary in size, shape, and angle to fit into a specific basin of sink basin 202.

In some embodiments, sink basin 202 may be a single sink basin. In some embodiments, sink basin 202 may include one or more sink dividers 218 to divide the sink into multiple basins, forming a double or even triple sink basin. Each basin of sink basin 202 can include a drain 216. In some embodiments, the basins of a double or triple sink basin 202 may be different in size and shape. In some embodiments, the basins of a double or triple sink basin 202 may be the same in size and shape. In some embodiments, particularly in embodiments in which the basins are different sizes, one basin may be sized to receive a colander 220 that is designed to complementarily fit in the basin.

Faucet 204 of kitchen sink system 200 can be attached or mounted to the kitchen sink system 200 at location that is behind or rearward from the sink basin 202. In some embodiments, faucet 204 may be located at a position that is proximate to a rear corner of sink basin 202, or at a location that is to a side of sink basin 202. In some embodiments, faucet 204 may include a pull-out sprayhead.

In some embodiments, kitchen sink system 200 can include a retractable nozzle feature 230, as shown in FIG. 2A. Retractable nozzle feature 230 feature can be located on a side of sink basin 202, or it may be located in a position that is rearward of sink basin 202. As shown, retractable nozzle feature 230 can include a base 210. In some embodiments, base 210 may be approximately horizontal. In some embodiments, base 210 may be slightly angled to allow for water to run along the angled surface of base 210 and into sink basin 202. For example, base 210 may be angled at about 0.5-15 degrees, about 1-10 degrees, or about 5-10 degrees. In some embodiments, base 210 may comprise a plurality of holes or openings, in which water may be configured to run through one or more holes in base 210 and into sink basin 202.

As shown in FIG. 2A, -retractable nozzle feature 230 includes at least one nozzle 214. Nozzle 214 may be configured to extend up from the surface of base 210 when in an active state. When in an inactive state, nozzle 214 may be configured to retract below the surface of base 210. FIG. 2A shows nozzle 214 in a retracted and inactive state. When activated (e.g., by an actuating mechanism), nozzle 214 can eject a water spray to rinse a dish (e.g., glass water bottle) or pressurized air to dry a dish (e.g., glass, water bottle) the interior surface of the drinking glass, for example.

FIG. 2C shows a close-up view of an upper surface 212 of a sink basin 202 that is configured to receive one or more interchangeable sink components. The upper surface 212 shown in FIG. 2C is located at a rear edge of sink basin 202. As shown, upper surface 212 may be chamfered. Sink basin 202 may also include a similarly chamfered upper surface 212 located at the front of the sink basin 202. Interchangeable sink component 208 (e.g., a cutting board) may include a complementary chamfered edge such that it can mate and rest on upper surface 212. In some embodiments, such as that shown in FIG. 2C, interchangeable sink component 208 may include a notched edge configured to mate with an upper edge (e.g., cornered edge) of the chamfered upper surface 212 of sink basin 202.

Figure 3A:
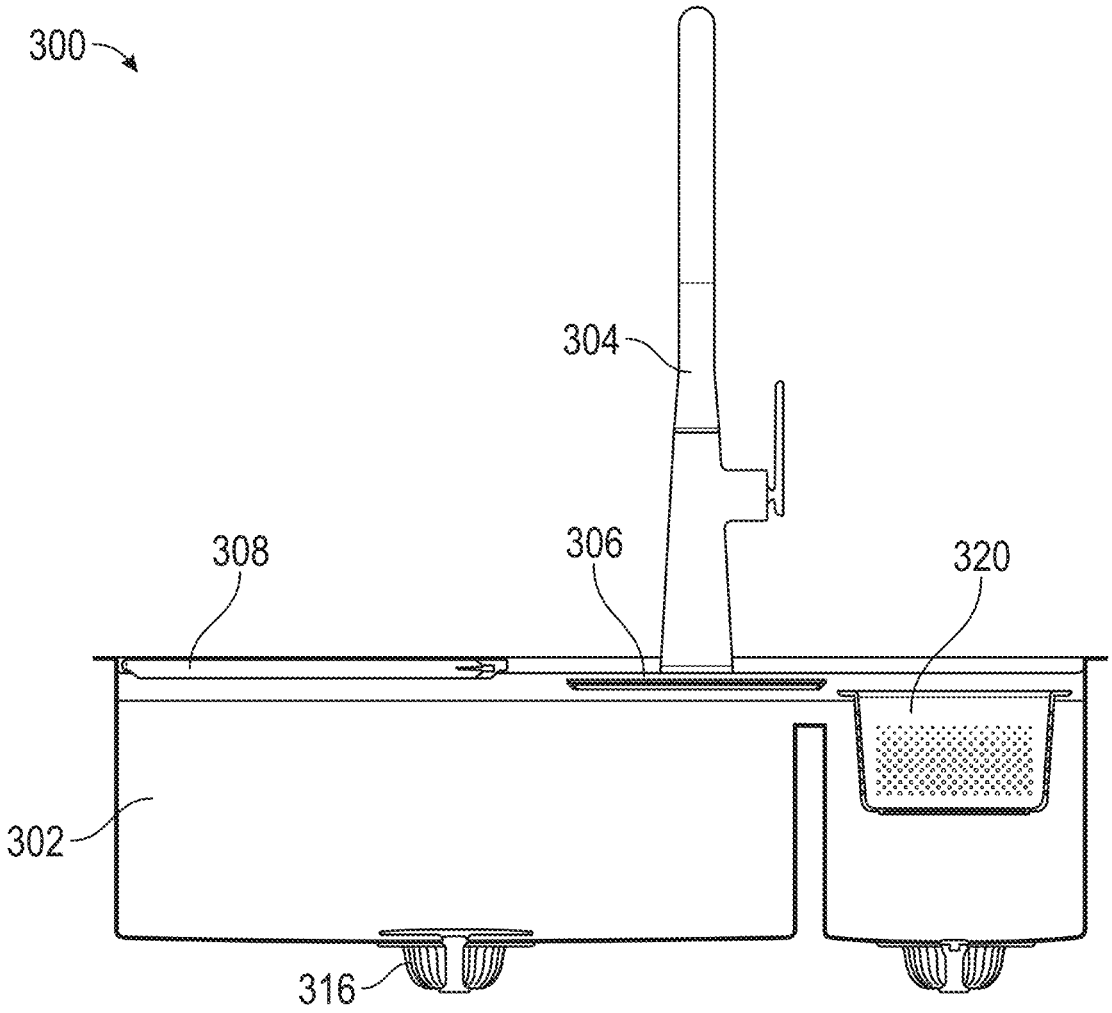
FIG. 3A shows a cross-sectional front view of a kitchen sink system without a retractable nozzle feature, according to some embodiments.
Figure 3B:
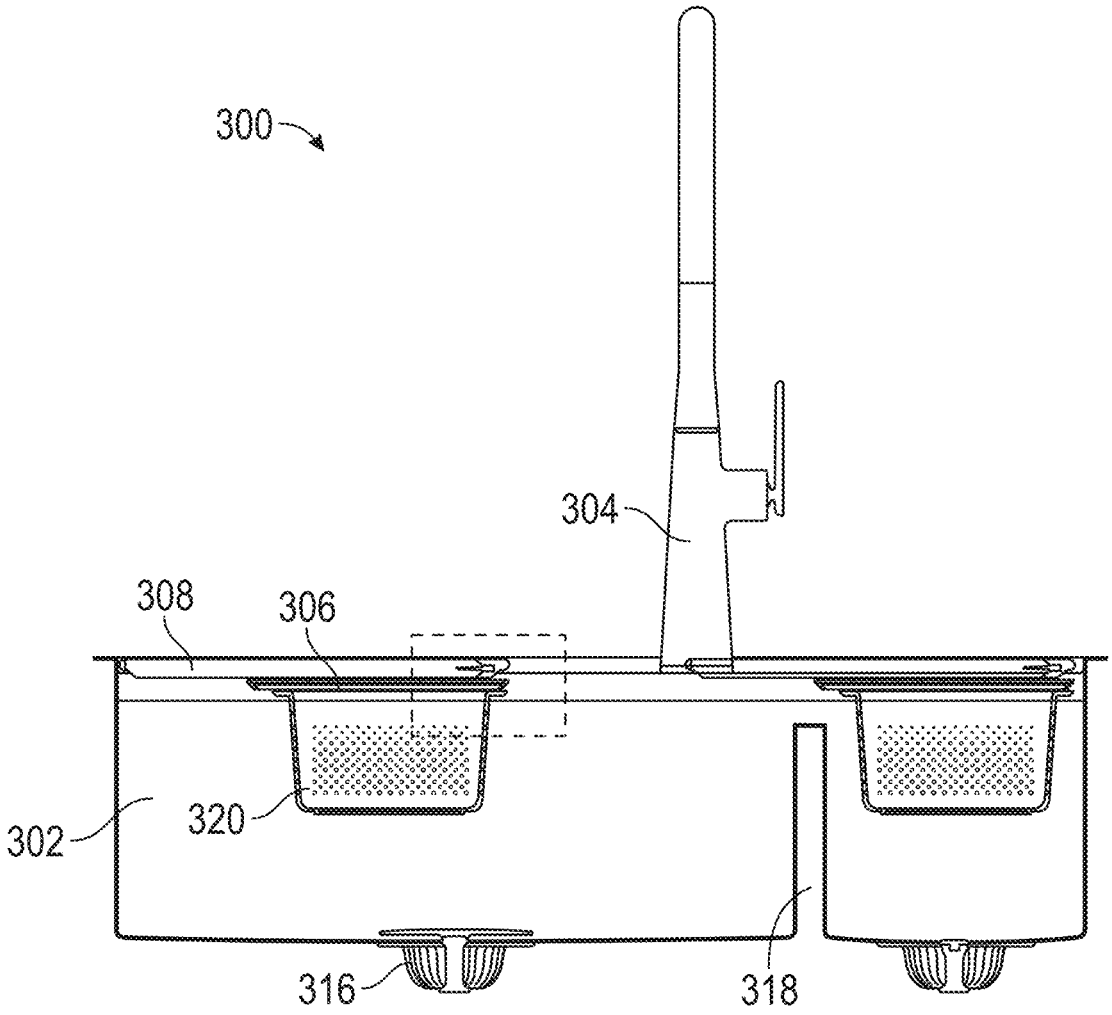
FIG. 3B shows a cross-sectional front view of a kitchen sink system without a retractable nozzle feature, according to some embodiments.

FIGS. 3A and 3B show a front cross-sectional view of a kitchen sink system 300 according to some embodiments. FIG. 3C shows a side cross-sectional view of a kitchen sink system 300 according to some embodiments. As shown, kitchen sink system 300 can include sink basin 302, faucet 304, upper surface 312 of sink basin 302, sink divider 318, drain 316, and one or more interchangeable sink components (e.g., cutting board 308, drying tray 306, colander 320). Note that kitchen sink system 300 does not include a retractable nozzle feature.

As shown in FIG. 3A, each of the interchangeable sink components (i.e., cutting board 308, drying tray 306, and colander 320) are removably coupled to sink basin 302 at different heights (i.e., the vertical distance between the bottom surface of the sink basin 302 and the point at which each interchangeable sink component comes in contact with the upper surface of the sink basin 302). Specifically, cutting board 308 is removably coupled to sink basin 302 at the greatest height. It can be stacked over top of drying tray 306 and/or colander 320 without interfering with either the drying tray 306 or colander 320. Cutting board 308 may also slide along upper surface 312 and over drying tray 306 and/or colander 320 to reposition cutting board 308 without having to remove and replace cutting board 308 from sink basin 302. Similarly, drying tray 306 is removably coupled to sink basin 302 at a height that is greater than that of colander 320. Thus, drying tray 306 can be stacked over top of colander 320 and/or slide along the upper surface 312 of sink basin 302 and past/overtop of colander 320.

Figure 3D:
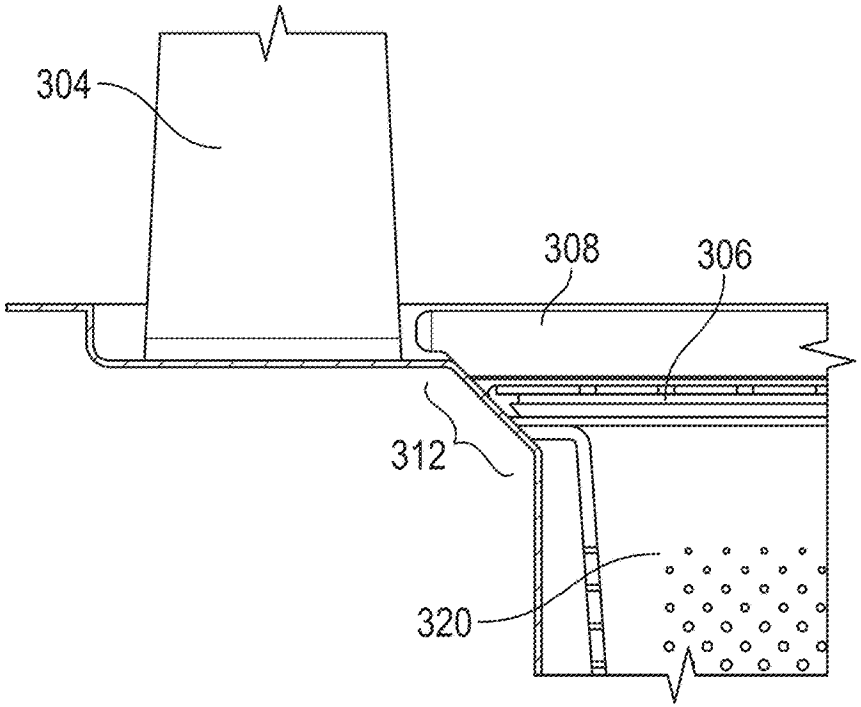
FIG. 3D shows a close-up view of three interchangeable sink components overlaying each other while coupled to an upper surface of a sink basin of a kitchen sink system, according to some embodiments.
Figure 3C:
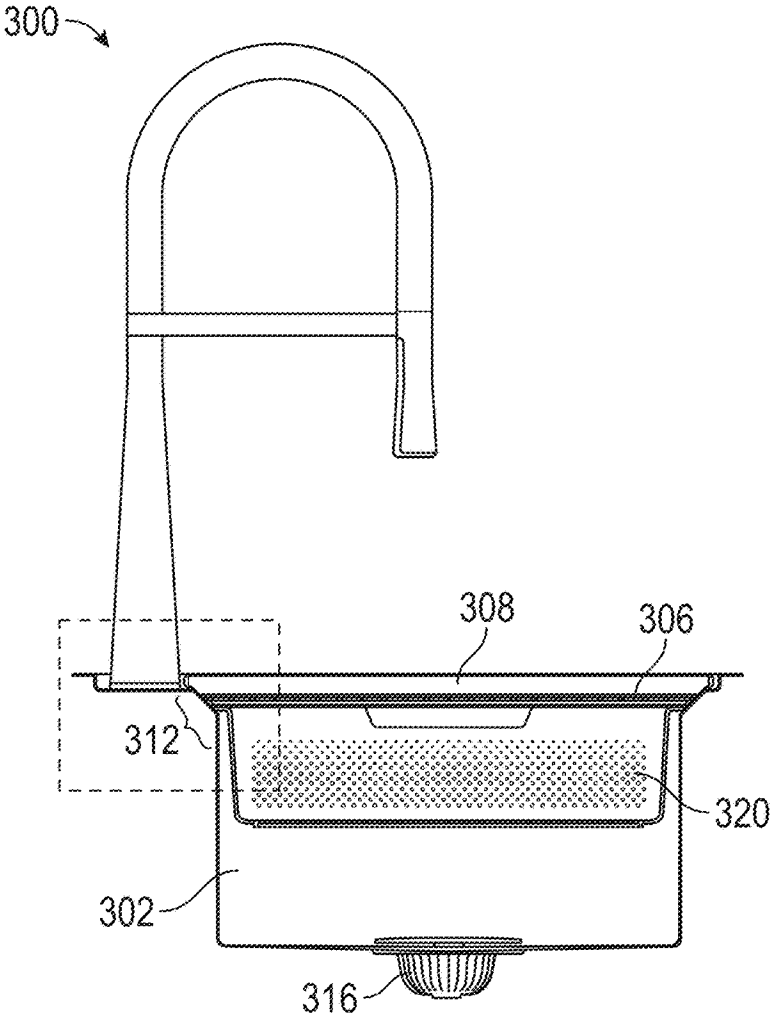
FIG. 3C shows a cross-sectional side view of a kitchen sink system, according to some embodiments.
Figure 3E:
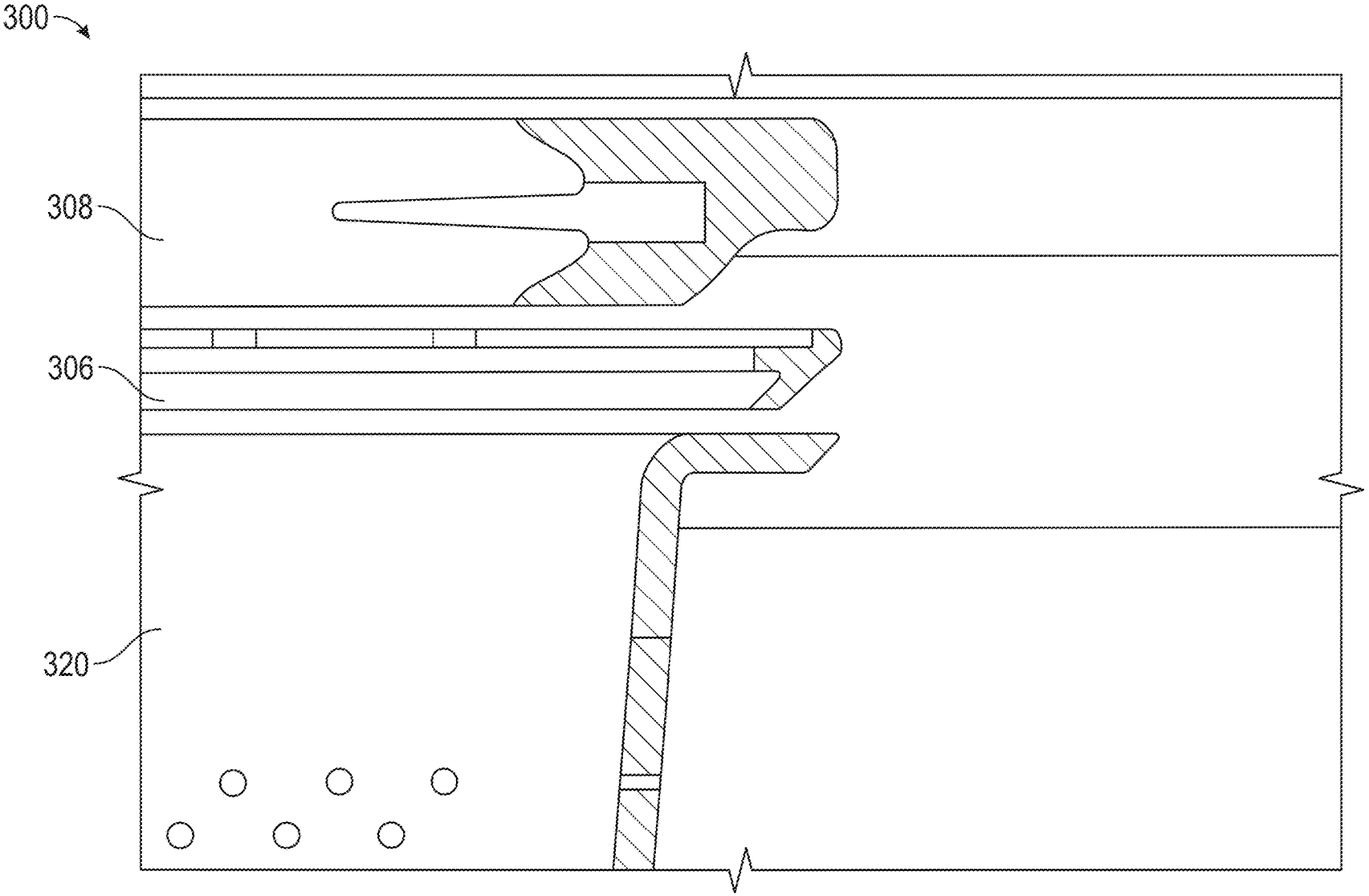
FIG. 3E shows a close-up view of a plurality of components overlaying each other, according to some embodiments.

FIGS. 3D and 3E show close-up views of a plurality of interchangeable sink components removably coupled to an upper surface 312 of sink basin 302. For example, the interchangeable sink components shown include, but need not be limited to, cutting board 308, drying tray 306, and colander 320. In some embodiments, the width of each interchangeable sink component may be slightly different, as shown in FIG. 3D, to allow for the interchangeable sink components to stack on top of each other and/or slide past each other while each is coupled/in contact with chamfered upper surface 312. Colander 320 has the smallest width as measured between a first edge (that is configured to align with upper surface 312) and a second edge (that is configured to align with upper surface 312), and as a result, sits lowest when removably coupled to upper surface 312. Drying tray 306 has a slightly larger width than that of colander 320, such that it sits just above colander 320 when removably coupled to chamfered upper surface 312. Cutting board 308 has the largest width of the here interchangeable sink components shown in FIG. 3D, and thus, sits the highest when removably coupled to upper surface 312 of sink basin 302. Each of colander 320, drying tray 306, and cutting board 308 have edges that are complementary with upper surface 312. In some embodiments, upper surface 312 of sink basin 302 is chamfered. Thus, each of the edges of the interchangeable sink components are also chamfered, or at least have a chamfered portion (e.g., the highest interchangeable sink component, for example cutting board 308, may comprise an edge having a lower chamfered portion and an upper lip extension. FIG. 3E shows a close-up view of the edges of each of the interchangeable sink components. As shown, some interchangeable sink components may comprise chamfered edges that complement that of upper surface 312. In some embodiments, an interchangeable sink component (i.e., the topmost interchangeable sink component) may include a chamfered portion as well as an upper lip extension configured to rest on a horizontal surface extending from sink basin 302. In some embodiments, an upper surface 312 that is chamfered may be chamfered at an angle between 10 and 90 degrees. In some embodiments, the chamfered upper surface 312 may be angled at about 20-70 degrees, about 30-60 degrees, or about 35-55 degrees.

The variable height configuration of the interchangeable sink components allows for more personalization and functionality with kitchen sink system 300. It further allows one interchangeable sink component to slide past another to reconfigure the positioning of the interchangeable sink components, without having to remove them. The "width" as discussed with respect to each of the interchangeable sink components is measured from a first edge of the interchangeable sink component that comes in contact with upper surface 312 when removably coupled to sink basin 302 to a second edge of the interchangeable sink component that comes in contact with upper surface 312 when removably coupled to sink basin 302. In some embodiments, the first edge is opposite the second edge of in the interchangeable sink component.

FIG. 3D shows the height of each of the edges of the interchangeable sink components with respect to the height of the upper surface 312 of sink basin 302. Specifically, the height of each of the edges of the interchangeable sink components, as measured from a bottom of the edge, along the surface of the edge, and to a top of the edge, is less than the height of the upper surface 312, as measured from a bottom of surface 312, along the surface, and to a top of surface 312. This difference in heights further allows multiple interchangeable sink components to be removably coupled to the upper surface 312 if sink basin 302.

Figure 4A:
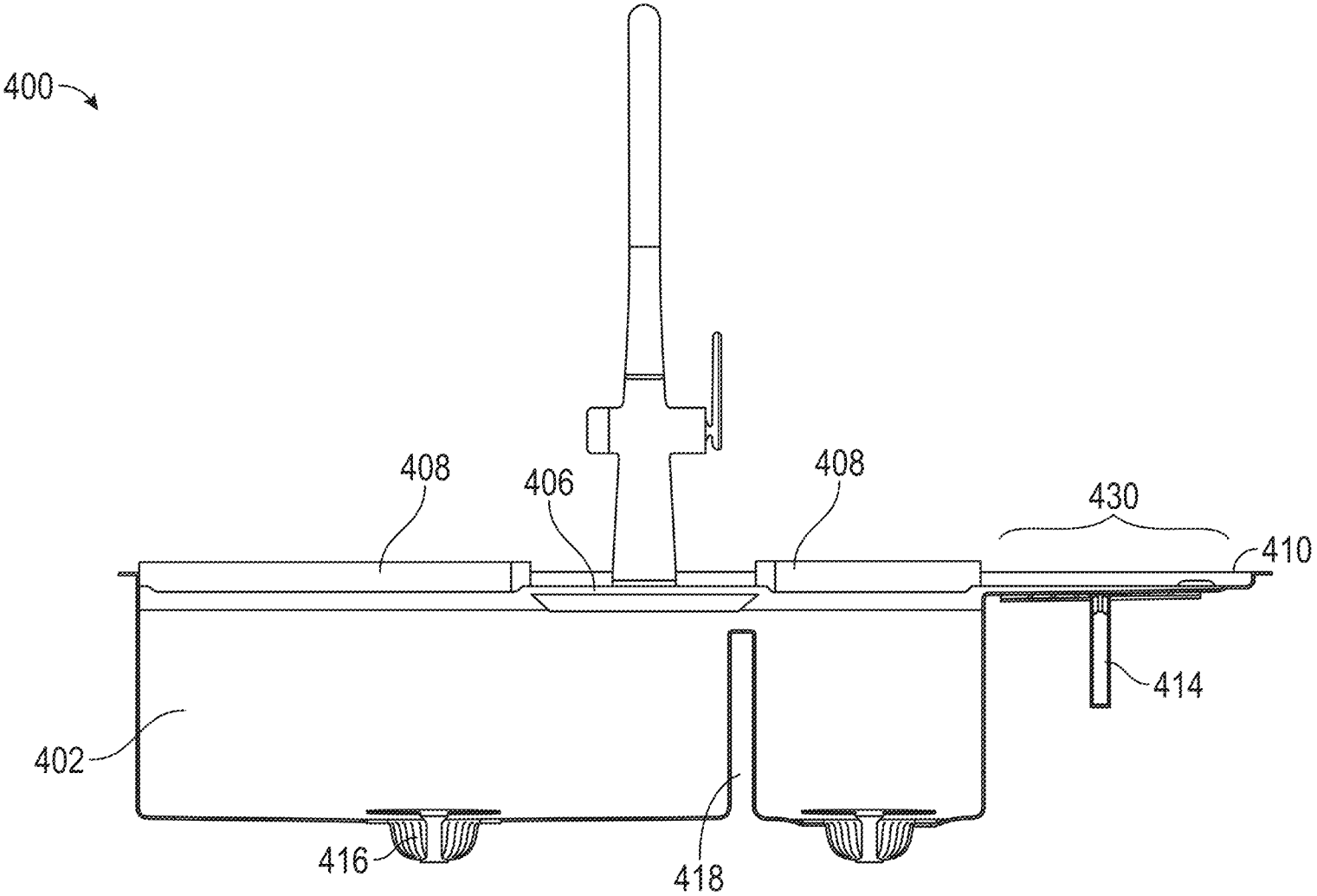
FIG. 4A shows a cross-sectional front view of a kitchen sink system with a retractable nozzle feature, according to some embodiments.
Figure 4C:
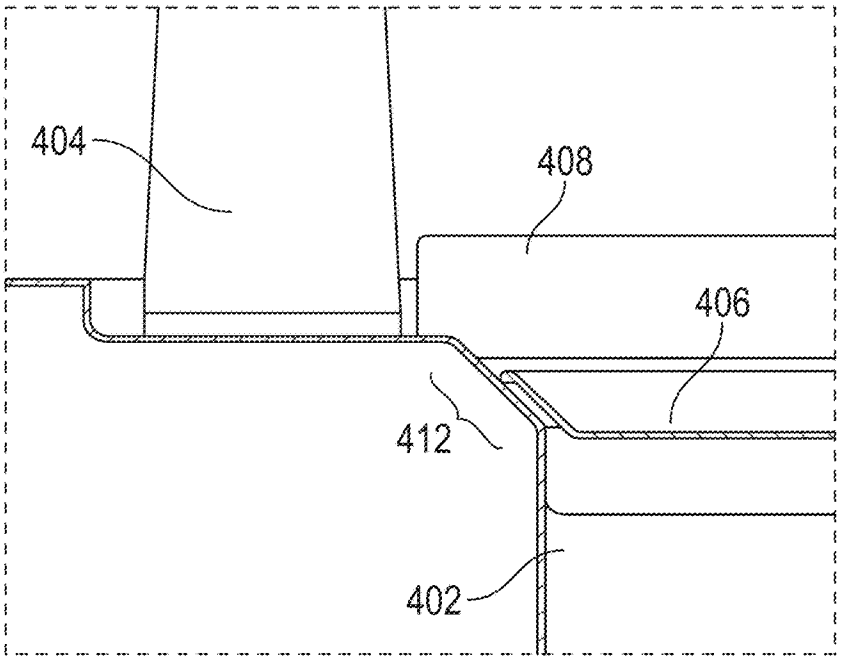
FIG. 4C shows a close-up view of a plurality of interchangeable sink components coupled to a kitchen sink basin at an upper surface, according to some embodiments.
Figure 4B:
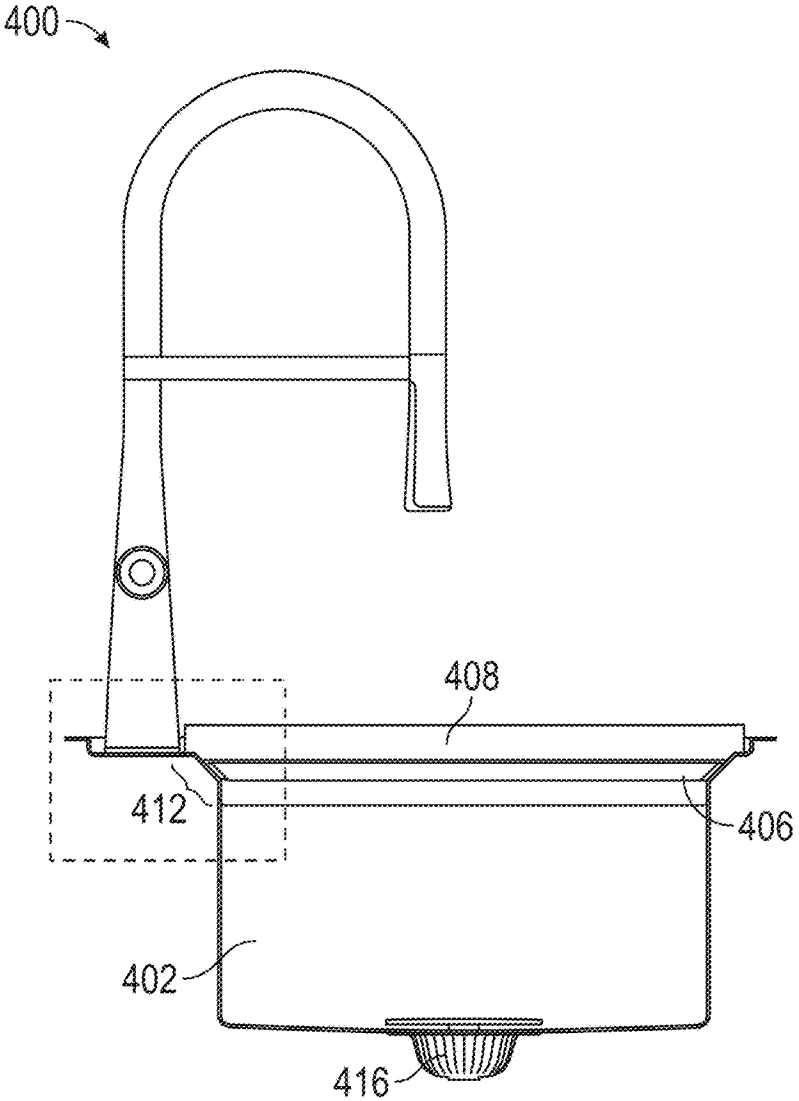
FIG. 4B shows a cross-sectional side view of a kitchen sink system, according to some embodiments.

FIG. 4A shows a front cross-sectional view of a kitchen sink system 400 according to some embodiments, and FIG. 4B shows a side cross-sectional view of a kitchen sink system 400 according to some embodiments. As shown, kitchen sink system 400 includes sink basin 402, faucet 404, drain 416, sink divider 418, retractable nozzle feature 430 comprising nozzle 414 and base 410 as well as a plurality of interchangeable sink components. Specifically, the interchangeable sink components shown in kitchen sink system 400 include tray 406 and two cutting boards 408.

In some embodiments, the two cutting boards 408 can be at the same height when removably coupled to the upper surface of sink basin 402. When configured to be positioned at the same height, the two cutting boards 408 may be able to be used alone or in combination with each other (i.e., to form a larger cutting board surface). In some embodiments, each of the cutting boards 408 may have different widths such that they are configured to sit at different heights when removably coupled to the upper surface of sink basin 402. In some embodiments, tray 406 may be configured to rest below one or both cutting boards 408. In some embodiments, one or more interchangeable sink components are configured to sit or rest (i.e., be removably coupled) on the upper surface of sink basin 402 in a position that is higher than an uppermost surface of sink divider 418. This allows for any of the one or more interchangeable sink component to be position over top of, or to slide past sink divider 418 without interfering with sink divider 418. In some embodiments, each interchangeable sink component can slide the full width of the sink basin 402 (i.e., from a left side to a right side of sink basin 402, and vice versa).

FIG. 4B shows faucet 404 mounted at a rear horizontal surface of kitchen sink system 400. Upper surface 412 of sink basin 402 is also shown. Interchangeable sink components are configured to removably couple to upper surface 412 of sink basin 402. Tray 406 is shown positioned slightly lower than that of cutting board 408. Here, both cutting boards 408 are configured to be positioned at the same height.

FIG. 4C shows a close-up cross-sectional view of cutting board 408 and tray 406 removably coupled to upper surface 412 of sink basin 402. In some embodiments, the chamfered surface of an interchangeable sink component may simply rest on the chamfered edge of upper surface 412. In some embodiments, a non-stick substrate (e.g., rubber or polymeric sheet/mat) may be adhered to the chamfered edge of an interchangeable sink component to help improve the adhesion of the interchangeable sink component to the upper surface 412 of sink basin 402. In some embodiments, interchangeable sink components may be configured to magnetically couple to the upper surface 412 of sink basin 402.

As shown in FIG. 4C, an interchangeable sink component may have a notched edge configured to removably couple to the upper surface 412 of sink basin 402. For example, cutting board 408 is shown with such a notched edge. The notched edge can comprise a chamfered lower portion configured to face the upper surface 412 when removably coupled, and an upper lip extension configured to overhang the edge of sink basin 402 when removably coupled.

Figure 5A:
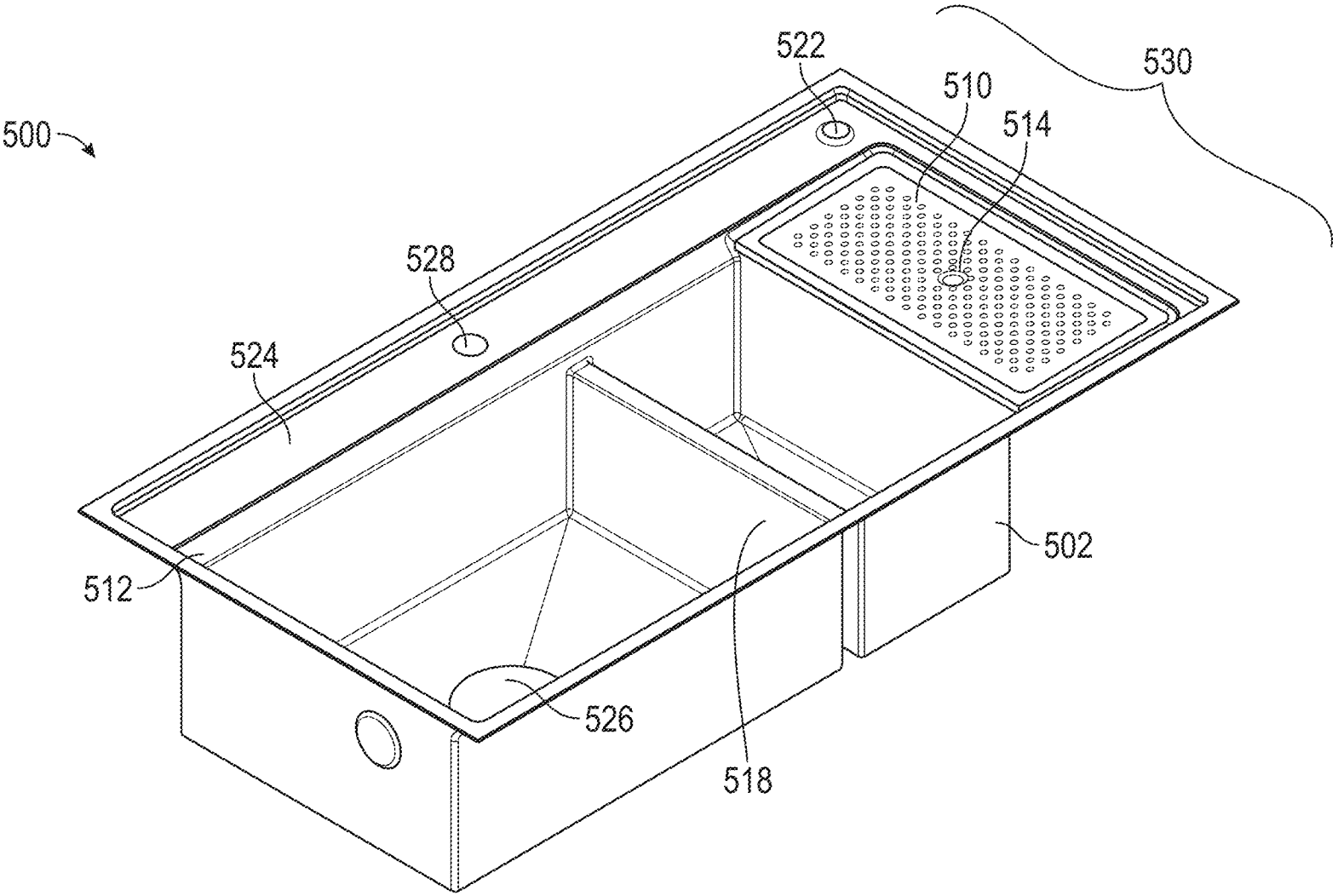
FIG. 5A shows a perspective view of a kitchen sink with a retractable nozzle feature, according to some embodiments.
Figure 5B:
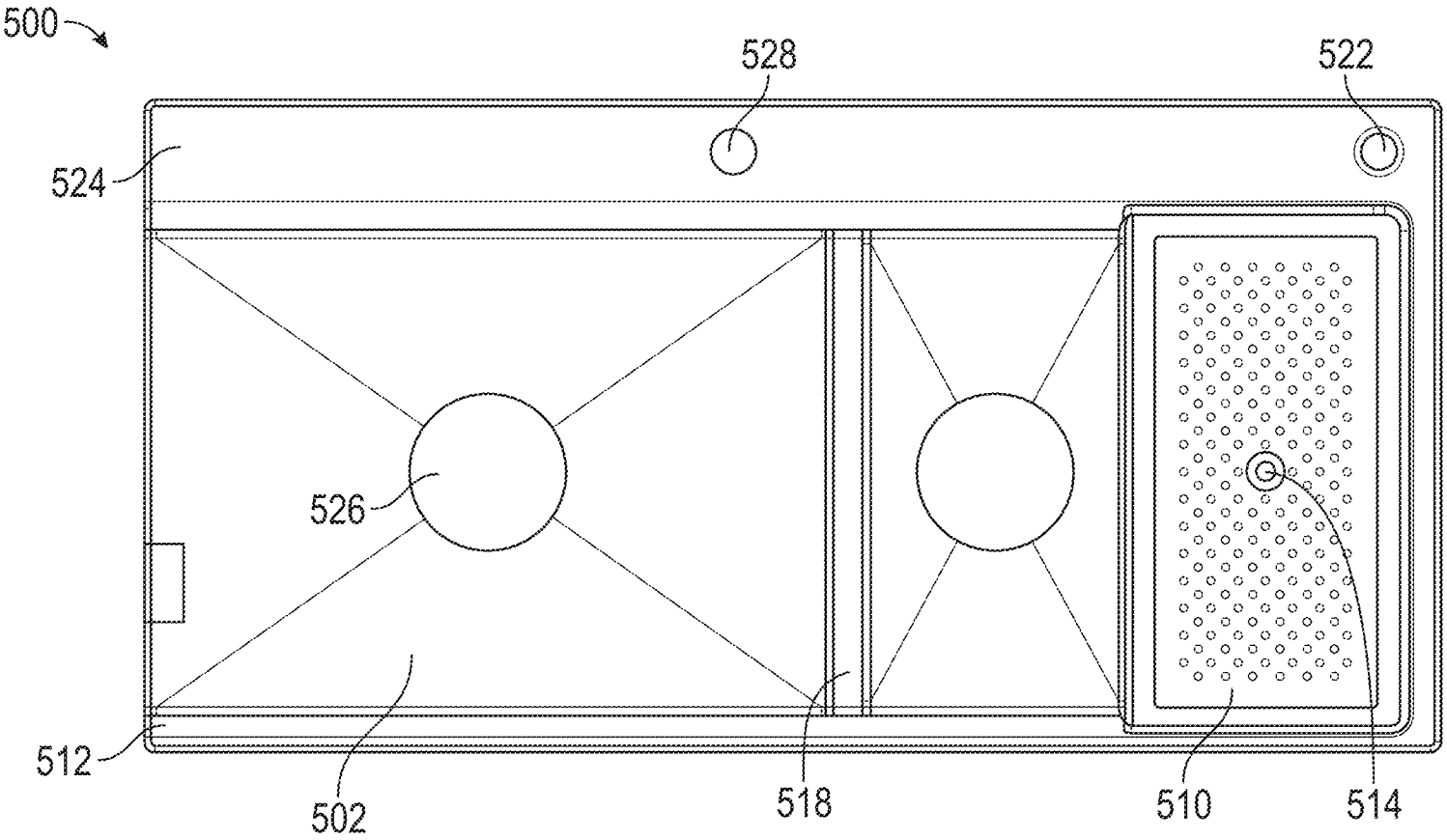
FIG. 5B shows a top view of a kitchen sink with a retractable nozzle feature, according to some embodiments.
Figure 5C:
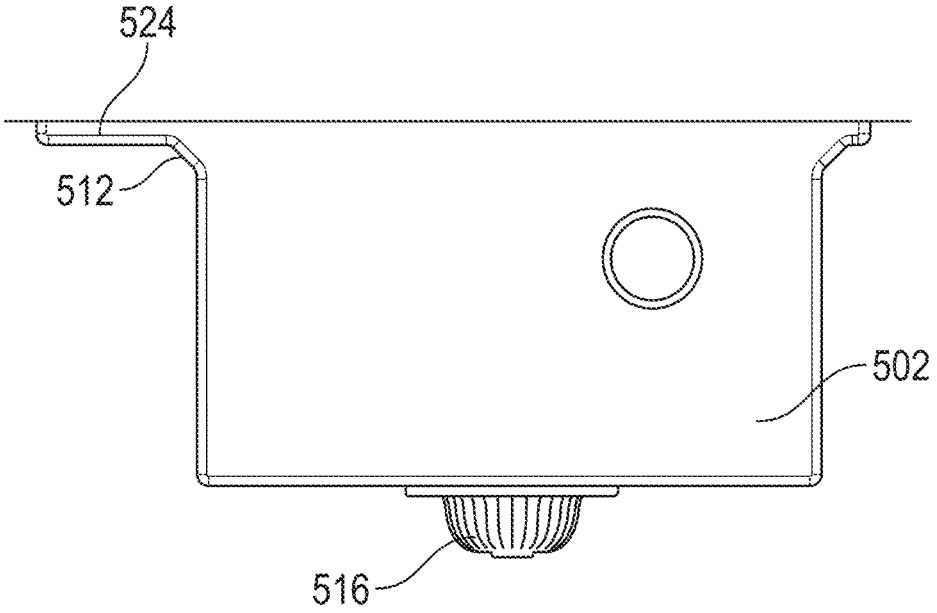
FIG. 5C shows a side view of a kitchen sink, according to some embodiments.
Figure 5D:
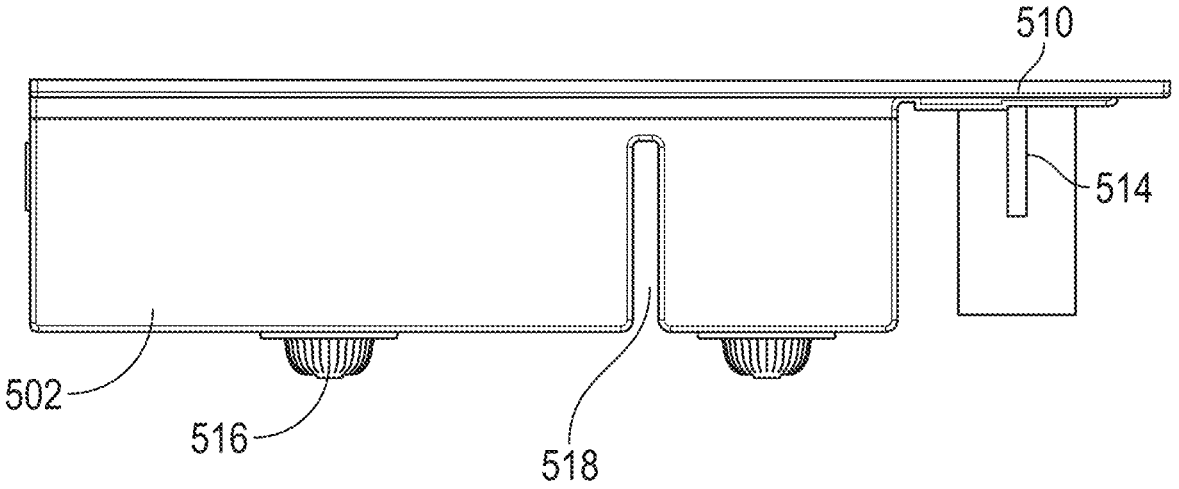
FIG. 5D shows a front view of a kitchen sink having a retractable nozzle feature, according to some embodiments.

FIG. 5A shows a perspective view of a kitchen sink 500, according to some embodiments. FIG. 5B shows a top view of a kitchen sink 500, according to some embodiments. FIG. 5C shows a side view of kitchen sink 500, according to some embodiments. FIG. 5D shows a front view of kitchen sink 500, according to some embodiments. Kitchen sink 500 can include sink basin 502, chamfered upper surface 512, and ledge surface 524. Ledge surface 524 can include an opening 528 to receive a faucet. Kitchen sink 500 can also include sink divider 518 that divides sink basin 502 into two or more basins. Sink basin 502 can include an opening 526 for a drain.

In some embodiments, kitchen sink 500 can include retractable nozzle feature 530 that includes actuating mechanism 522, base 510, and nozzle 514.

Figure 6A:
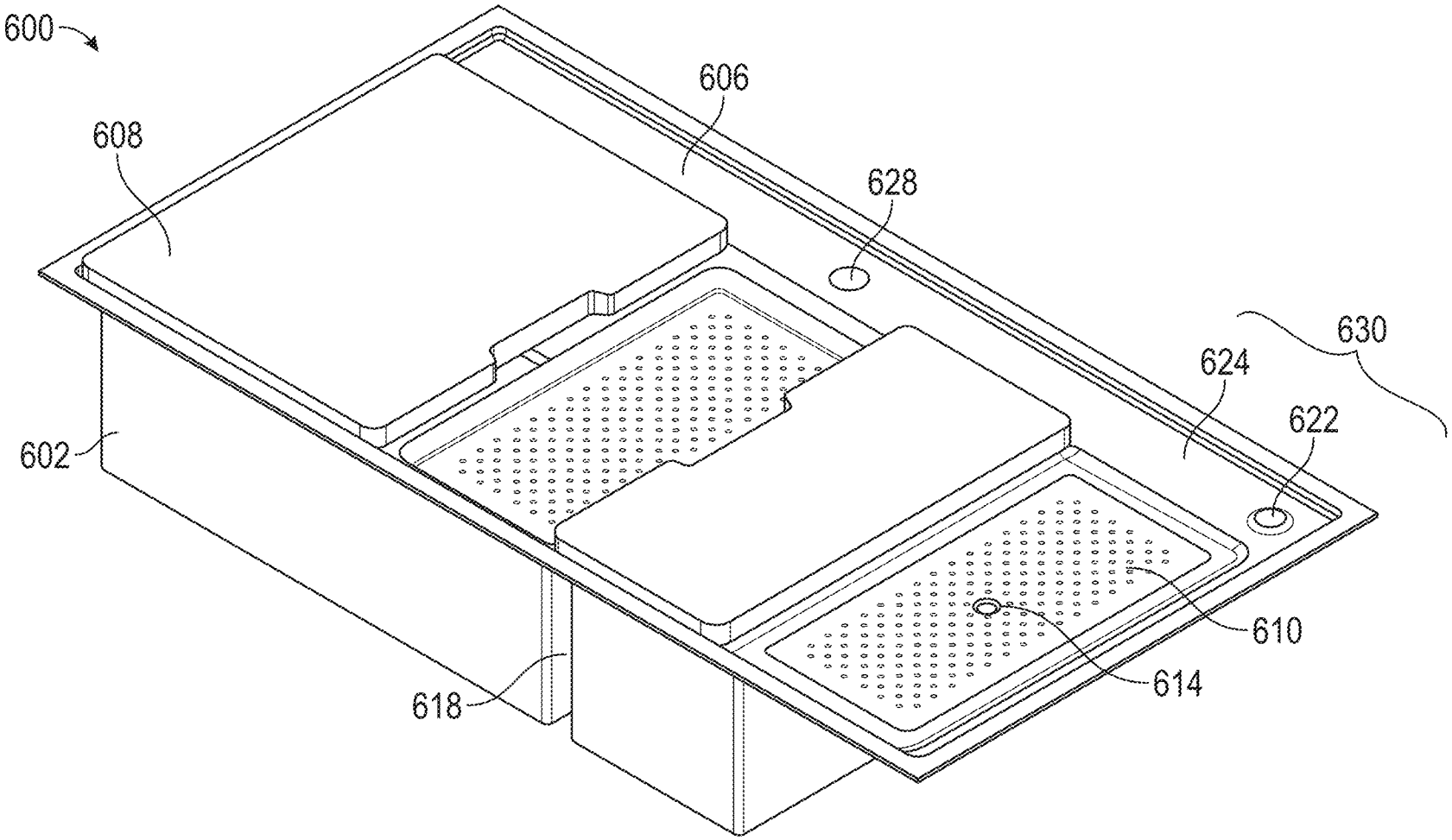
FIG. 6A shows a perspective view of a kitchen sink system with a retractable nozzle feature, according to some embodiments.
Figure 6B:
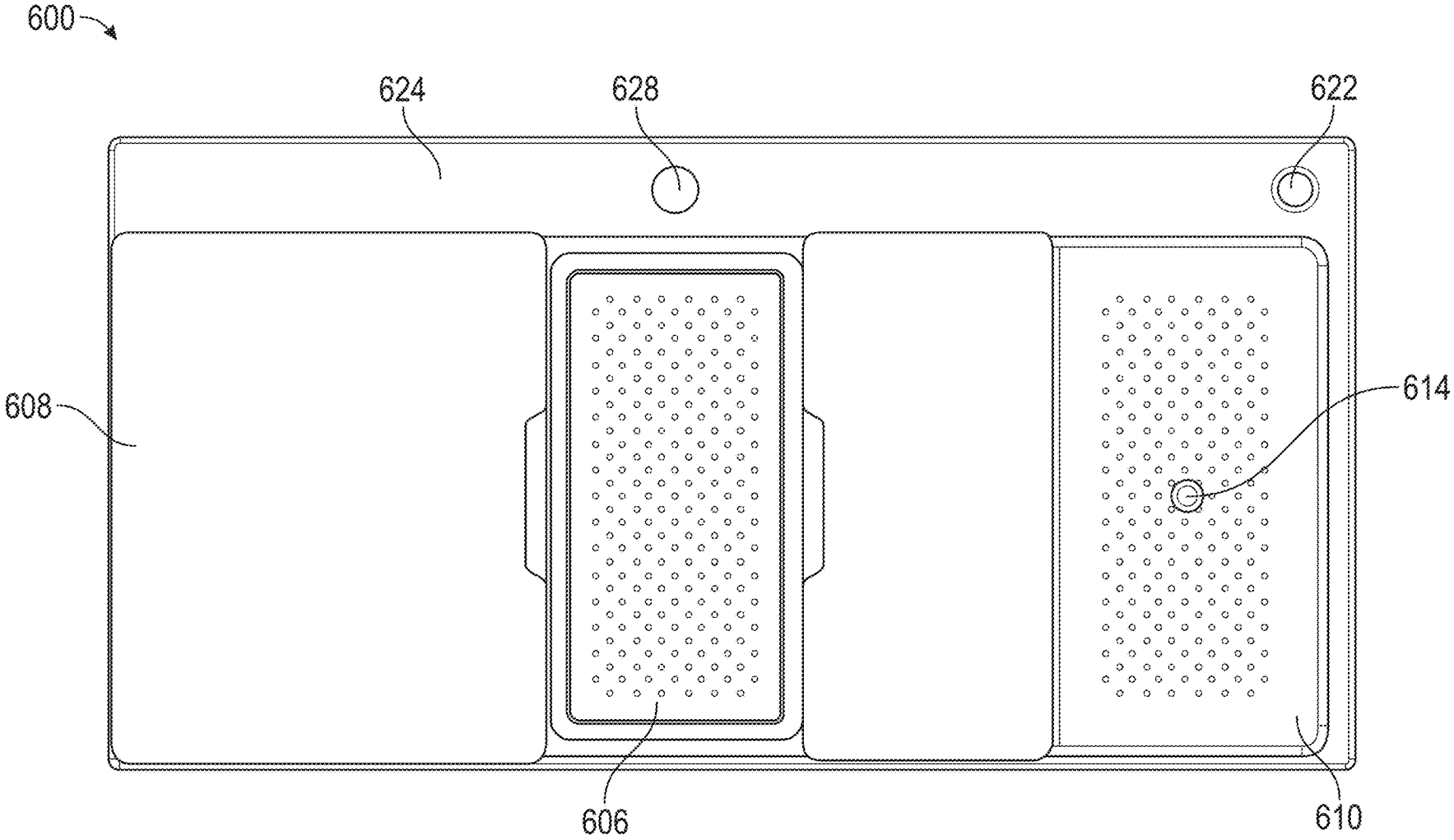
FIG. 6B shows a top view of a kitchen sink system with a retractable nozzle feature, according to some embodiments.
Figure 6C:
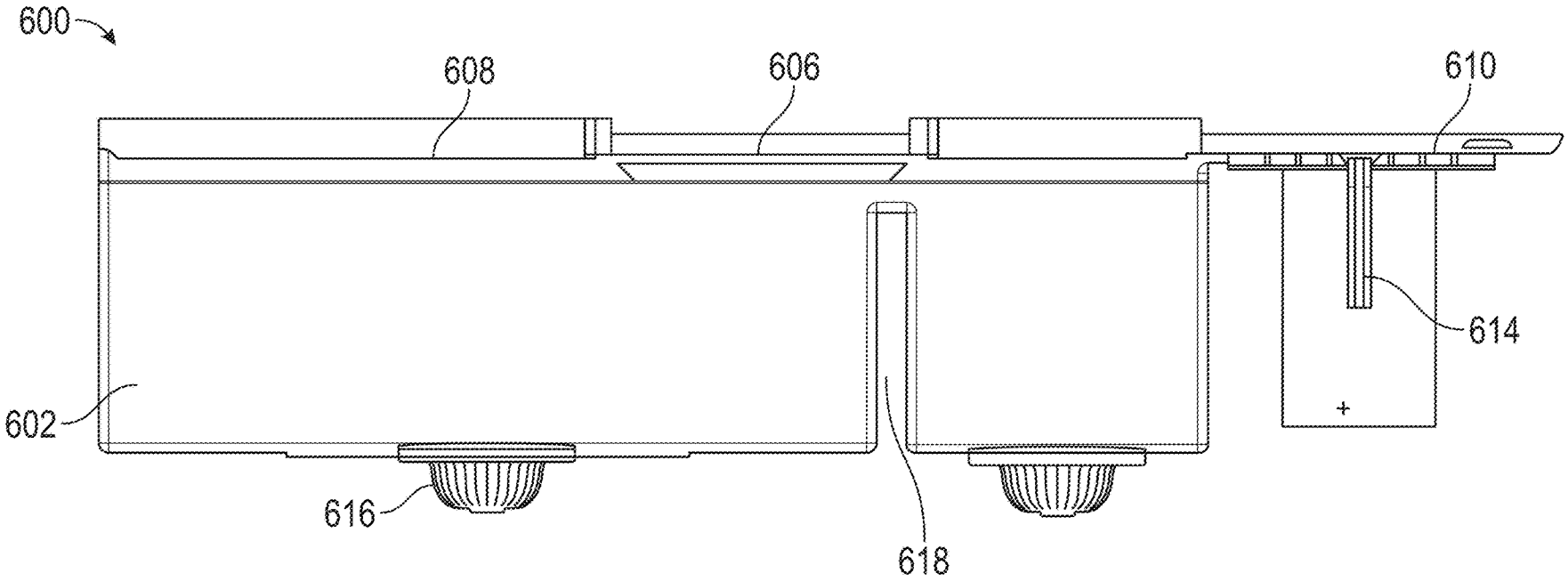
FIG. 6C shows a cross-sectional front view of a kitchen sink system having a retractable nozzle feature, according to some embodiments.

FIG. 6A shows a perspective view of a kitchen sink system 600, according to some embodiments. FIG. 6B shows a top view of a kitchen sink system 600, according to some embodiments. FIG. 6C shows a front view of a kitchen sink system 600, according to some embodiments. As shown, kitchen sink system 600 includes sink basin 602, sink divider 618, rear surface 624, opening 628 for a faucet, retractable nozzle feature 630 comprising actuating mechanism 622, base 610, and nozzle 614. Kitchen sink system 600 also includes a plurality of interchangeable sink components includes two cutting boards 608 and tray 606. In some embodiments, both cutting boards 608 are configured to be removably coupled to the upper surface of sink basin 602 at the same height, such that they may be used together (i.e., to form a single, large cutting board surface) or separately. Either cutting board 608 may be configured to be placed on top of tray 606 and/or slide over tray 606.

Figure 7C:
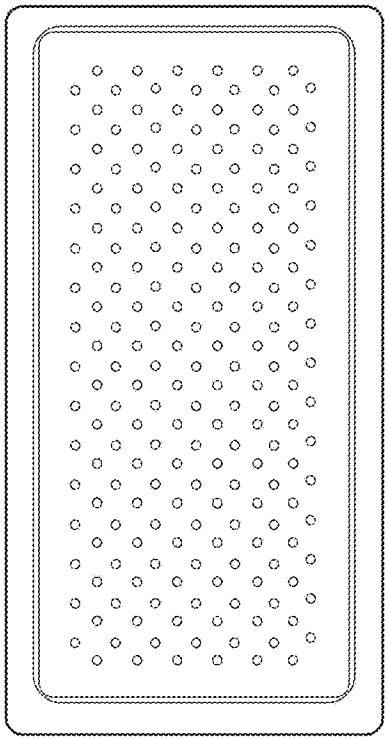
FIG. 7C shows a top view of an interchangeable sink component of a kitchen sink system, according to some embodiments.
Figure 7B:
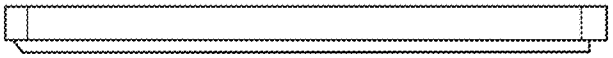
FIG. 7B shows a side view of an interchangeable sink component of a kitchen sink system, according to some embodiments.
Figure 7A:
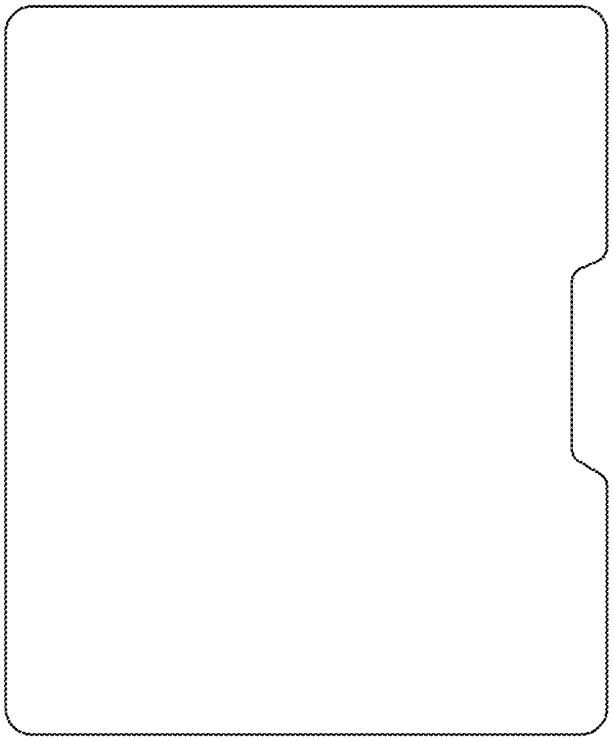
FIG. 7A shows a top view of an interchangeable sink component of a kitchen sink system, according to some embodiments.
Figure 7F:
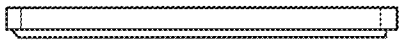
FIG. 7F shows a side view of an interchangeable sink component of a kitchen sink system, according to some embodiments.
Figure 7E:
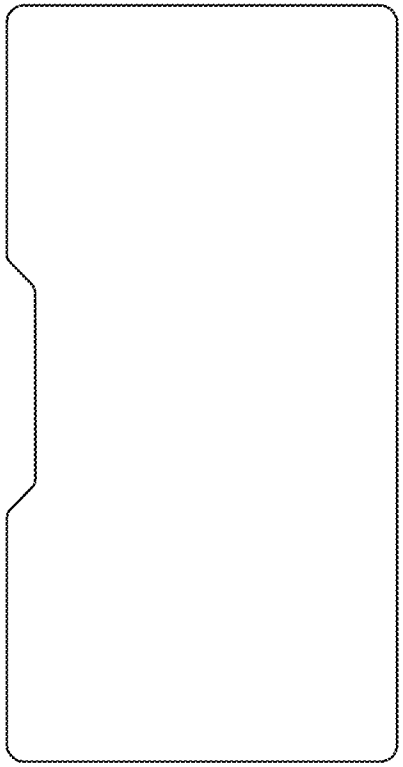
FIG. 7E shows a top view of an interchangeable sink component of a kitchen sink system, according to some embodiments.
Figure 7D:
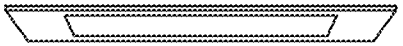
FIG. 7D shows a side view of an interchangeable sink component of a kitchen sink system, according to some embodiments.

FIGS. 7A and 7E each show a top view of cutting boards 708 that are configured to be used with a kitchen sink system described herein, and FIGS. 7B and 7F show a side view of such cutting boards 708. FIG. 7C shows a top view and FIG. 7D shows a side view of a tray 706 that is configured to be used with a kitchen sink system described herein. As discussed above, interchangeable sink components, including the cutting boards 708 and tray 706 of FIGS. 7A-7F may include two opposing edges configured to align and mate with an upper surface of a sink basin of a kitchen sink system. In some embodiments, the opposing edges are chamfered. In some embodiments, the two opposing edges configured to removably couple with the sink basin are a front and rear edge of the interchangeable sink component.

In some embodiments, cutting board 708 may comprise a notched inset on one or more sides of the cutting board 708. This notched inset may be configured to allow a user to easily grab the cutting board 708 to remove, replace, or move it to another location. Cutting board 708 may comprise a food-safe closed-grain hardwood, bamboo, plastic (e.g., high density polyethylene (HDPE)), or the like. In some embodiments, tray 706 may include a plurality of holes in a lower surface of the tray to allow water to drain from an interior of tray 706 through the plurality of holes and to the sink basin of a kitchen sink system. In some embodiments, tray 706 may comprise stainless steel, powder coated or rubber coated metal, polypropylene, bamboo, teak, or the like.

In some embodiments, cutting board 708 may have a length of about 10-24 or about 12-20 inches. In some embodiments, cutting board 708 may have a length of less than or equal to about 24, about 22, about 20, about 18, about 16, about 14, or about 12 inches. In some embodiments, cutting board 708 may have a length greater than or equal to about 10, about 12, about 14, about 16, about 18, about 20, or about 22 inches. In some embodiments, cutting board 708 may have a width of about 6-30, about 8-24, or about 10-20 inches. In some embodiments, cutting board 708 may have a width of less than or equal to about 24, about 22, about 20, about 18, about 16, about 14, about 12, about 10, or about 8 inches. In some embodiments, tray 706 may have a width of greater than or equal to about 6, about 8, about 10, about 12, about 14, about 16, about 18, about 20, or about 22 inches.

In some embodiments, tray 706 may have a length of about 10-24 or about 12-20 inches. In some embodiments, tray 706 may have a length of less than or equal to about 24, about 22, about 20, about 18, about 16, about 14, or about 12 inches. In some embodiments, tray 706 may have a length of greater than or equal to about 24, about 22, about 20, about 18, about 16, about 14, or about 12 inches. In some embodiments, tray 706 may have a width of about 6-30, about 8-24, or about 10-20 inches. In some embodiments, tray 706 may have a width of less than or equal to about 24, about 22, about 20, about 18, about 16, about 14, about 12, about 10, or about 8 inches. In some embodiments, tray 706 may have a width of greater than or equal to about 6, about 8, about 10, about 12, about 14, about 16, about 18, about 20, or about 22 inches.

Figure 8A:
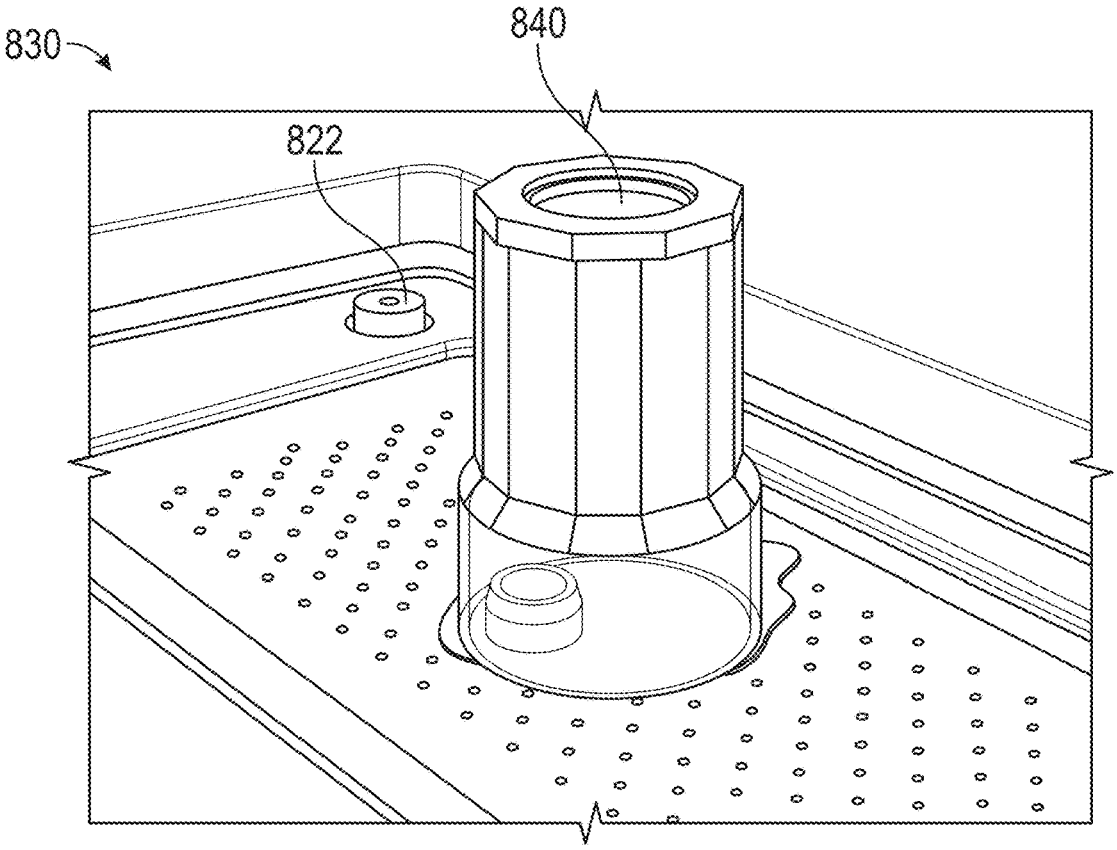
FIG. 8A shows an image of a retractable nozzle feature, according to some embodiments.

FIG. 8A shows an image of a drinking glass 840 placed over a nozzle of a retractable nozzle feature 830 of a kitchen sink system according to some embodiments. When activated (i.e., by actuating mechanism 822) the nozzle extends up from the surface (i.e., base 810) and into an enclosed space formed by drinking glass 840. The nozzle is configured to eject a spray (e.g., a spray of water, soapy water, pressurized air) into the enclosed space and to an interior surface of the drinking glass 840 to rinse or dry the interior surface of the drinking glass 840.

Figure 8B:
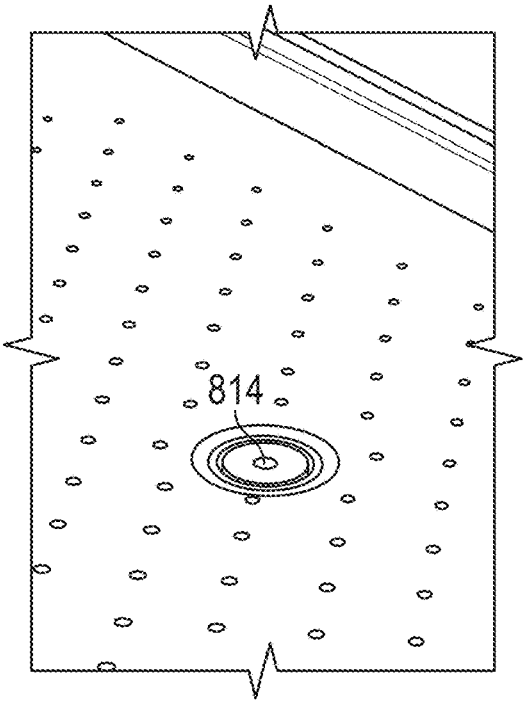
FIG. 8B shows a close-up view of a retracted spray nozzle of a retractable nozzle feature, according to some embodiments.
Figure 8C:
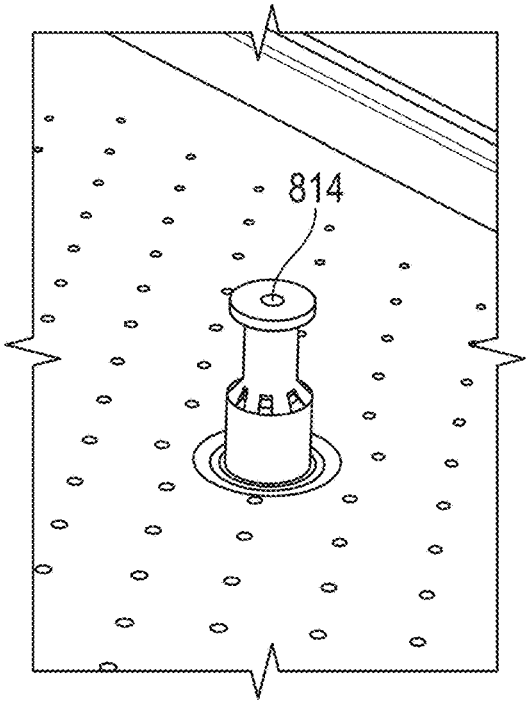
FIG. 8C shows a close-up view of an extended spray nozzle of a retractable nozzle feature, according to some embodiments.

FIG. 8B shows a nozzle 814 of a retractable nozzle feature in a retracted position such that the retractable nozzle feature 830 is in an inactive state. FIG. 8C shows nozzle 814 of a retractable nozzle feature 830 in an extended position such that the retractable nozzle feature 830 is in an active state.

Figure 9:
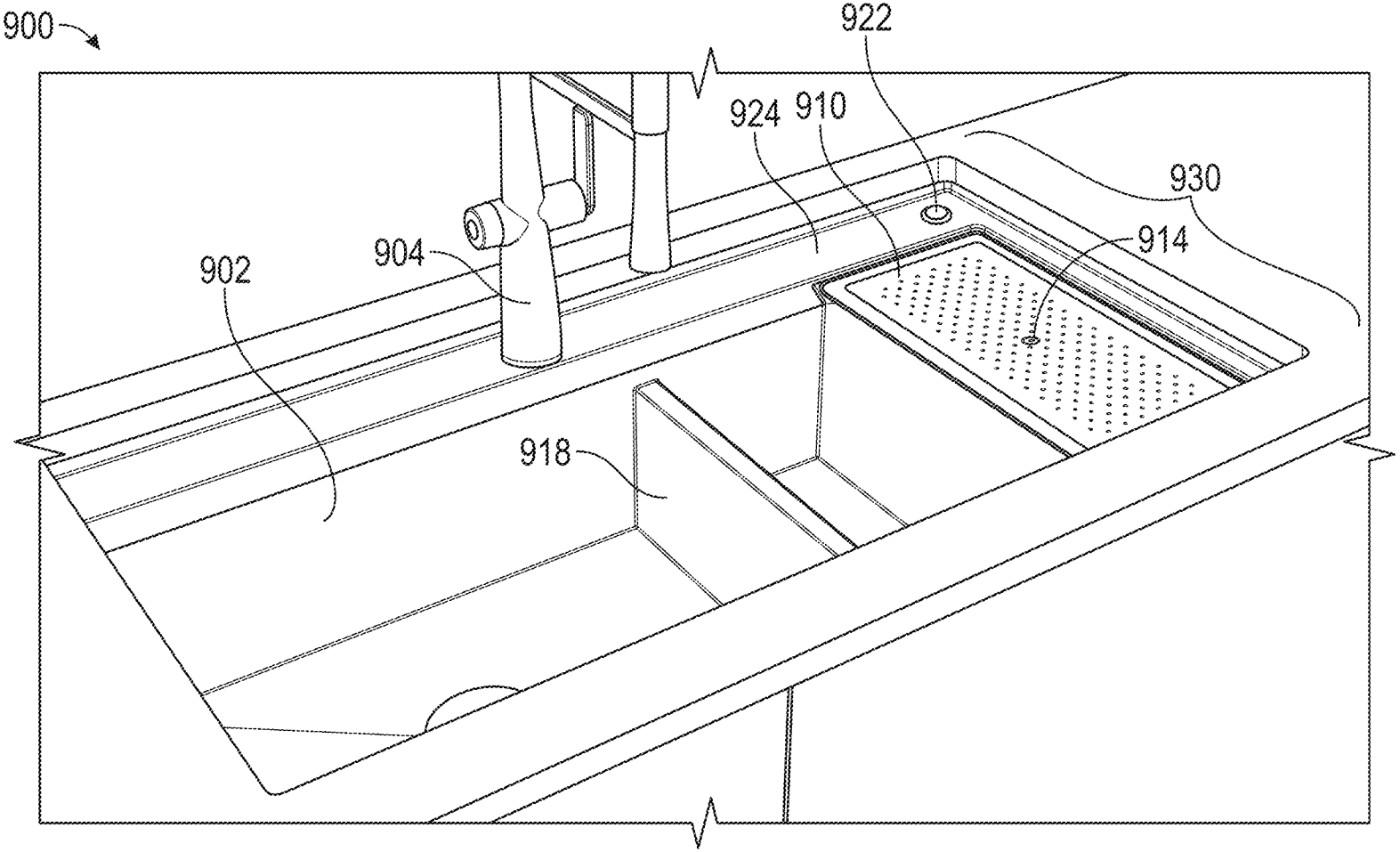
FIG. 9 shows a perspective view of a kitchen sink system with a retractable nozzle feature, according to some embodiments.

FIG. 9 shows an image of a kitchen sink system 900 according to some embodiments. Kitchen sink system 900 can include sink basin 902, faucet 904, sink divider 918, rear surface 924, retractable nozzle feature 930 comprising actuating mechanism 922, base 910, and nozzle 914. Kitchen sink system 900 may be configured to receive one or more interchangeable sink components.

Figure 10:
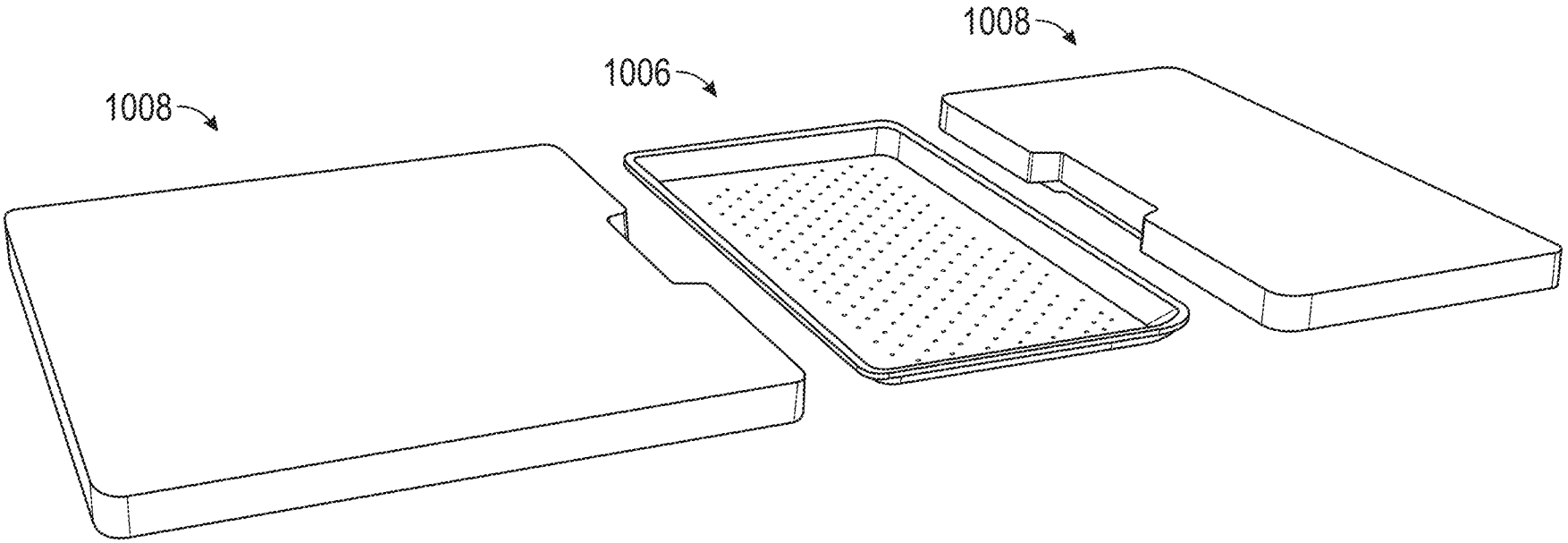
FIG. 10 shows a perspective view of three interchangeable sink components, according to some embodiments.

FIG. 10 shows a perspective view of three interchangeable sink components, according to some embodiments. Specifically, FIG. 10 shows two cutting boards 1008 and a tray 1006, according to some embodiments. The two cutting boards 1008 may be the same size and shape, or they may be different sizes/shapes. Each of the interchangeable sink components may comprise two or more chamfered edges.

Figure 11:
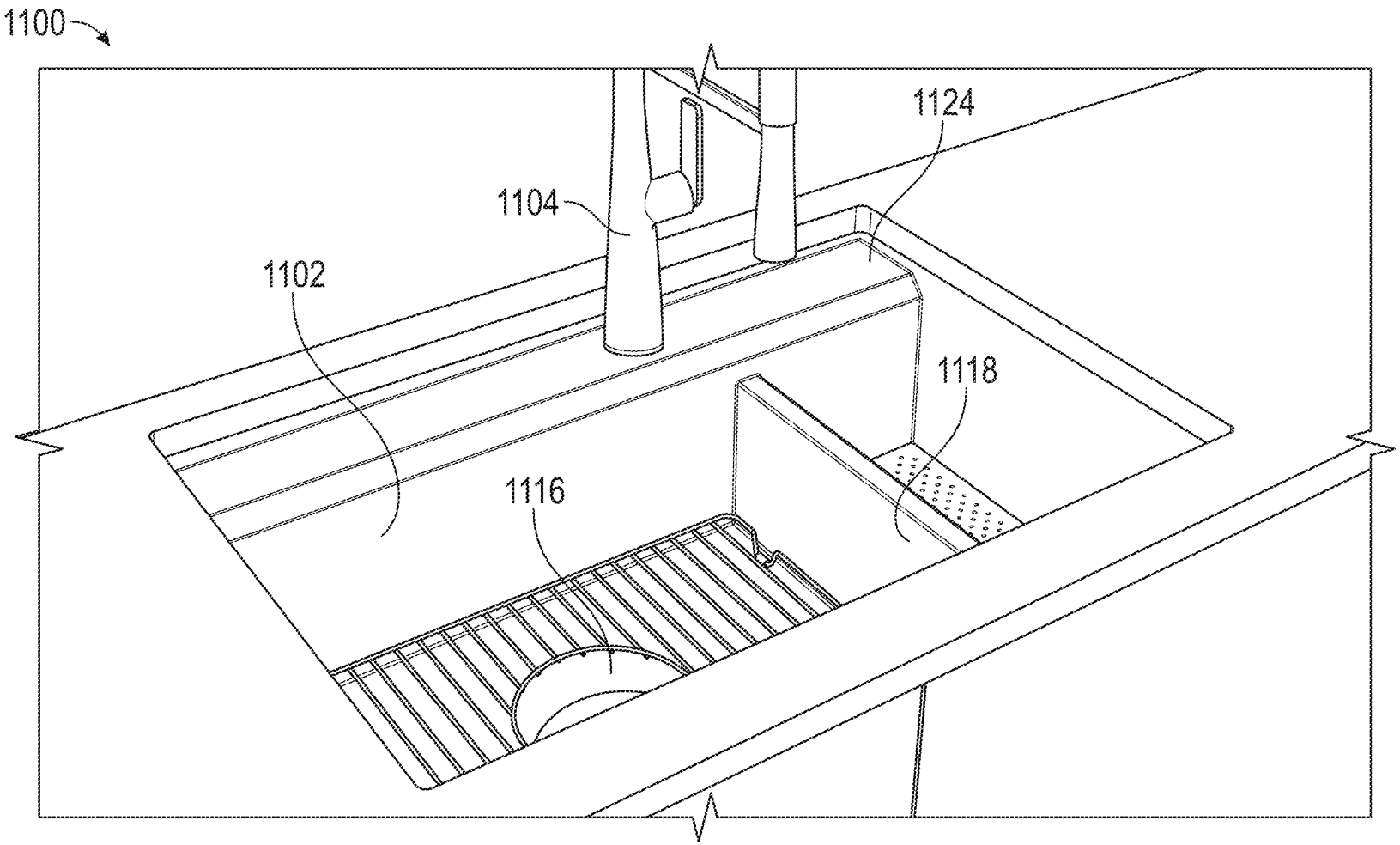
FIG. 11 shows a perspective view of a kitchen sink system, according to some embodiments.

FIG. 11 shows a perspective view of a kitchen sink system 1100 according to some embodiments. Kitchen sink system 1100 can include sink basin 1102, faucet 1104, sink divider 1118 (in the case of a double, triple sink basin), and drain 1116. Kitchen sink system 1100 is not shown with a retractable nozzle feature, but a retractable nozzle feature may be included in some embodiments. Further, kitchen sink system 1100 may include any number of interchangeable sink components configured to removably couple to the upper surface of sink basin 1102. For example, kitchen sink system 1100 can include one or more interchangeable sink components such as cutting boards, drying trays, colanders, etc., as described herein. Sink divider 1118 is configured such that an upper surface of sink divider 1118 is lower than a lowest surface of one or more interchangeable sink components. When sink divider 1118 is lower than a lowest surface of one or more interchangeable sink components, said interchangeable sink components can slide from one sink basin to another without interfering with sink divider 1118.

Figure 12:
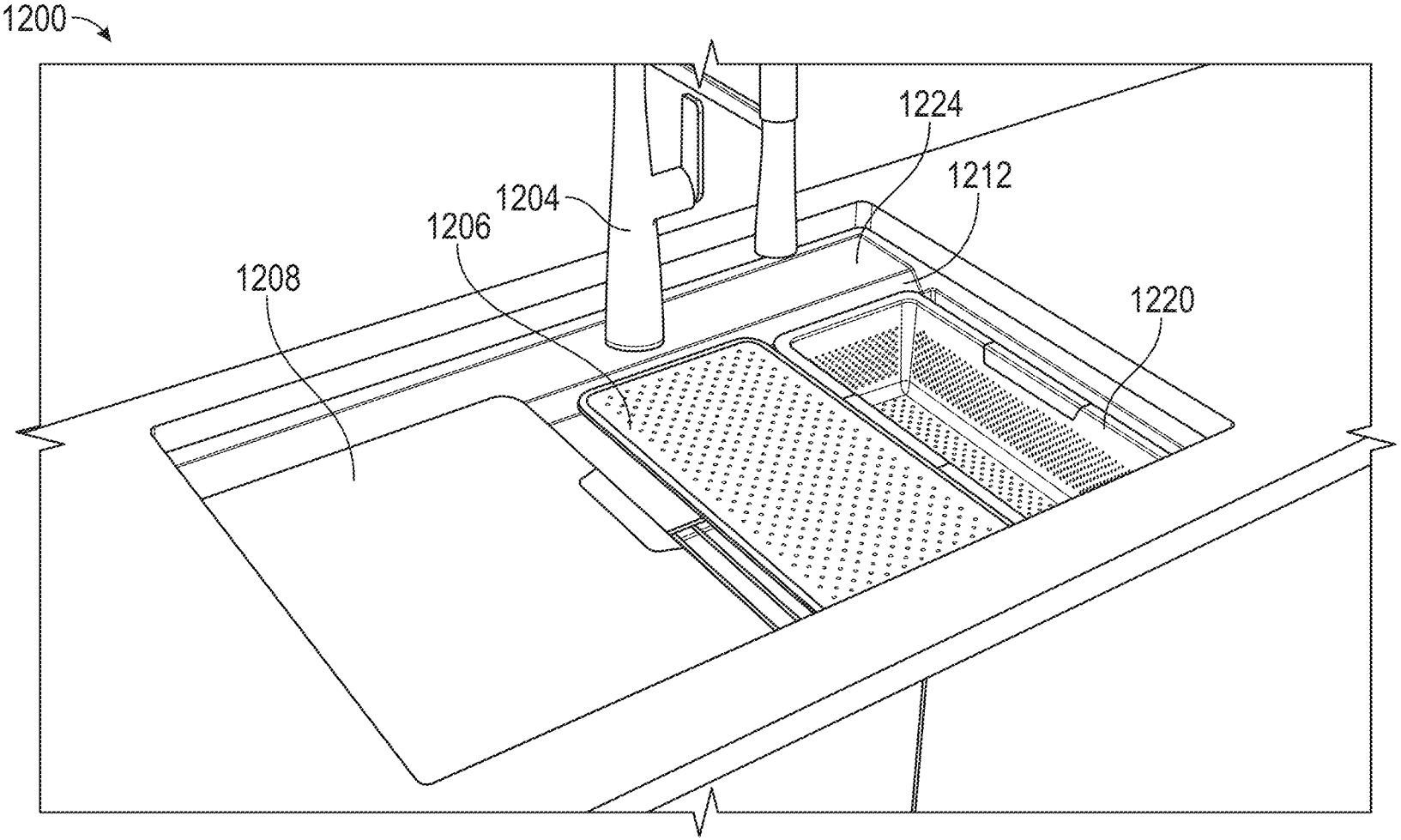
FIG. 12 shows a perspective view of a kitchen sink system, according to some embodiments.

FIG. 12 shows a perspective view of a kitchen sink system 1200 according to some embodiments. Kitchen sink system 1200 can include faucet 1204, ledge surface 1224 of the sink basin, upper surface 1212 of the sink basin, and a plurality of interchangeable sink components including, for example, cutting board 1208, drying tray 1206, and colander 1220. In some embodiments, kitchen sink system 1200 can also include a retractable nozzle feature.

As shown, the plurality of interchangeable sink components can be removably coupled to upper surface 1212 of the sink basin. In some embodiments, as described herein, upper surface 1212 may be chamfered. The edge of the plurality of interchangeable sink components may also be chamfered, such that the outer edge of an interchangeable sink component may complement the chamfered edge of upper surface 1212.

Figure 13:
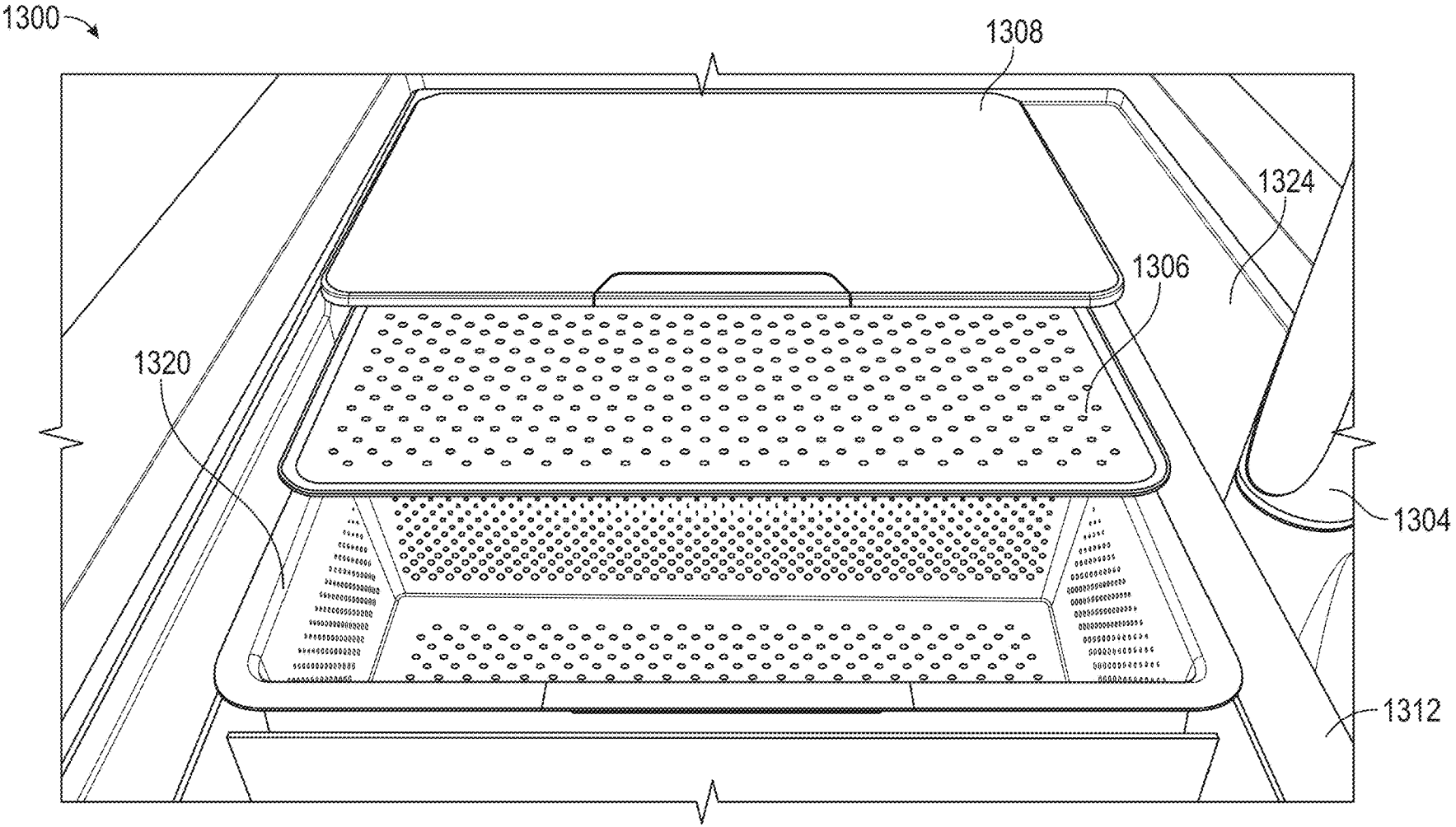
FIG. 13 shows a perspective view of a plurality of interchangeable sink components removably coupled to a sink basin of a kitchen sink system, according to some embodiments.

FIG. 13 shows a perspective view of a plurality of interchangeable sink components removably coupled to a sink basin of a kitchen sink system 1300, according to some embodiments. As shown, kitchen sink system 1300 can include faucet 1304, upper surface 1312 of sink basin, ledge surface 1324 of sink basin, and a plurality of interchangeable sink components including, but not limited to, cutting board 1308, drying tray 1306, and colander 1320. In some embodiments, cutting board 1308 is configured to sit at a height that is greater than that of drying tray 1306, which is configured to sit at a height that is greater than that of colander 1320. However, kitchen sink system 1300 is completely functional with any one, any two or more, or no interchangeable sink components removably coupled to the sink basin.

The foregoing description sets forth exemplary systems, methods, techniques, parameters, and the like. It should be recognized, however, that such description is not intended as a limitation on the scope of the present disclosure but is instead provided as a description of exemplary embodiments.

Although the description herein uses terms first, second, etc. to describe various elements, these elements should not be limited by the terms. These terms are only used to distinguish one element from another.

The invention claimed is:

1. A kitchen sink system comprising:

a sink basin comprising an upper rear surface and an upper front surface; and a plurality of interchangeable sink components configured to removably couple to the sink basin, each interchangeable sink component of the plurality of interchangeable sink components comprising a first edge and a second edge opposite the first edge, wherein the first edge of each interchangeable sink component is configured to align with the upper rear surface of the sink basin and the second edge of each interchangeable sink component is configured to align with the upper front surface of the sink basin, wherein a first interchangeable sink component is configured to removably couple to the sink basin at a first height as measured vertically from a bottom surface of the sink basin to a horizontal plane that intersects with a top of the first edge and the second edge of the first interchangeable sink component, and a second interchangeable sink component is configured to removably couple to the sink basin at a second height as measured vertically from a bottom surface of the sink basin to a horizontal plane that intersects with a top of the first edge and second edge of the second interchangeable sink component, wherein the first height is greater than the second height, and the first interchangeable sink component is configured to slide past the second interchangeable sink component along the upper rear surface and upper front surface of the sink basin, wherein both the upper rear surface and the upper front surface of the sink basin are chamfered at an angle between about 30 and about 60 degrees.

2. The kitchen sink system of claim 1, wherein the sink basin comprises a double sink basin comprising a first basin separated from a second basin by a sink divider, wherein an upper surface of the sink divider is lower than a lowest surface of the first interchangeable sink component such that the first interchangeable sink component is configured to slide from the first basin to the second basin while removably coupled to the upper rear surface and the upper front surface of the sink basin.

3. The kitchen sink system of claim 1, wherein both the first edge of a second interchangeable sink component and the second edge of the second interchangeable sink component are chamfered.

4. The kitchen sink system of claim 1, wherein the first edge of a second interchangeable sink component is a first chamfered edge and the upper front surface of the sink basin is a upper front chamfered surface, and a height of the first chamfered edge of the second interchangeable sink component as measured from a top of the first chamfered edge, along a surface of the first chamfered edge, and to a bottom of the first chamfered edge is shorter than a height of the upper front chamfered surface of the sink basin as measured from a top of the upper front chamfered surface, along a surface of the upper front chamfered surface, and to a bottom of the upper front chamfered surface.

5. The kitchen sink system of claim 1, wherein the first edge and the second edge of the first interchangeable sink component each comprise a chamfered portion.

6. The kitchen sink system of claim 1, comprising a retractable nozzle feature, the retractable nozzle comprising:

a base surface proximate to the sink basin, wherein a side edge of the base surface extends from a top portion of a side surface of the sink basin;

one or more retractable nozzles disposed in the base surface; and an actuating mechanism, wherein when the actuating mechanism is actuated, the one or more retractable nozzles are configured to extend upward from the base surface, and when the actuating mechanism is not actuated, the one or more retractable nozzles are configured to retract such that a top surface of the one or more retractable nozzles is flush with a portion of the base surface.

7. The kitchen sink system of claim 6, wherein the one or more retractable nozzles are configured to dispense pressurized air.

8. The kitchen sink system of claim 6, wherein the one or more retractable nozzles are configured to dispense water.

9. The kitchen sink system of claim 1, wherein the plurality of interchangeable sink components can comprise one or more of a cutting board, a drying tray, or a colander.

10. The kitchen sink system of claim 1, wherein the first interchangeable sink component comprises a cutting board.

11. The kitchen sink system of claim 1, wherein the second interchangeable sink component comprises a drying tray, wherein the drying tray comprises a plurality of openings allowing water to pass from an interior surface of the drying tray, through the plurality of openings, and into the sink basin.

12. The kitchen sink system of claim 1, wherein a third interchangeable sink component comprises a colander, wherein the colander comprises a plurality of openings allowing water to pass from an interior surface of the colander, through the plurality of openings, and into the sink basin.

13. The kitchen sink system of claim 1, comprising a fourth interchangeable sink component configured to removably couple to the sink basin at a fourth height as measured vertically from a bottom surface of the sink basin to a horizontal plane that intersects with a top of the first edge and the second edge of the fourth interchangeable sink component, wherein the first height and the fourth height are the same.

14. The kitchen sink system of claim 1, wherein a distance between a rear side interior surface of the sink basin and a front side interior surface of the sink basin is shorter than a width of each interchangeable sink component, the width of each interchangeable sink component being measured along a top of the interchangeable sink component between the first edge and the second edge, such that each interchangeable sink component is configured to removably couple to the sink basin by placing each interchangeable sink component over the sink basin and aligning the first edge of each interchangeable sink component with the upper rear surface of the sink basin and the second edge of each interchangeable sink component with the upper front surface of the sink basin.

15. The kitchen sink system of claim 1, wherein a width of the first interchangeable sink component is greater than a width of the second interchangeable sink component, wherein the width of the first interchangeable sink component is measured along a top of the first interchangeable sink component from the first edge to the second edge, and the width of the second interchangeable sink component is measured along a top of the second interchangeable sink component from the first edge to the second edge.

16. A kitchen sink system comprising:

a sink basin comprising an upper rear surface and an upper front surface; and a plurality of interchangeable sink components configured to removably couple to the sink basin, each interchangeable sink component of the plurality of interchangeable sink components comprising a first edge and a second edge opposite the first edge, wherein the first edge of each interchangeable sink component is configured to align with the upper rear surface of the sink basin and the second edge of each interchangeable sink component is configured to align with the upper front surface of the sink basin, wherein a first interchangeable sink component is configured to removably couple to the sink basin at a first height as measured vertically from a bottom surface of the sink basin to a horizontal plane that intersects with a top of the first edge and the second edge of the first interchangeable sink component, and a second interchangeable sink component is configured to removably couple to the sink basin at a second height as measured vertically from a bottom surface of the sink basin to a horizontal plane that intersects with a top of the first edge and second edge of the second interchangeable sink component, wherein the first height is greater than the second height, and the first interchangeable sink component is configured to slide past the second interchangeable sink component along the upper rear surface and upper front surface of the sink basin, wherein both the first edge of a second interchangeable sink component and the second edge of the second interchangeable sink component are chamfered.

17. The kitchen sink system of claim 16, wherein the first edge and the second edge of the first interchangeable sink component each comprise a chamfered portion.

18. A kitchen sink system comprising:

a sink basin comprising an upper rear surface and an upper front surface; and a plurality of interchangeable sink components configured to removably couple to the sink basin, each interchangeable sink component of the plurality of interchangeable sink components comprising a first edge and a second edge opposite the first edge, wherein the first edge of each interchangeable sink component is configured to align with the upper rear surface of the sink basin and the second edge of each interchangeable sink component is configured to align with the upper front surface of the sink basin, wherein a first interchangeable sink component is configured to removably couple to the sink basin at a first height as measured vertically from a bottom surface of the sink basin to a horizontal plane that intersects with a top of the first edge and the second edge of the first interchangeable sink component, and a second interchangeable sink component is configured to removably couple to the sink basin at a second height as measured vertically from a bottom surface of the sink basin to a horizontal plane that intersects with a top of the first edge and second edge of the second interchangeable sink component, wherein the first height is greater than the second height, and the first interchangeable sink component is configured to slide past the second interchangeable sink component along the upper rear surface and upper front surface of the sink basin, wherein the first edge and the second edge of the first interchangeable sink component each comprise a chamfered portion.

19. The kitchen sink system of claim 18, wherein the first edge of a second interchangeable sink component is a first chamfered edge and the upper front surface of the sink basin is a upper front chamfered surface, and a height of the first chamfered edge of the second interchangeable sink component as measured from a top of the first chamfered edge, along a surface of the first chamfered edge, and to a bottom of the first chamfered edge is shorter than a height of the upper front chamfered surface of the sink basin as measured from a top of the upper front chamfered surface, along a surface of the upper front chamfered surface, and to a bottom of the upper front chamfered surface.

* * * * *